US009170010B2

(12) United States Patent
Velazquez

(10) Patent No.: US 9,170,010 B2
(45) Date of Patent: Oct. 27, 2015

(54) DMX CONTROLLABLE LOW PROFILE LIGHTING APPARATUS

(75) Inventor: Toby Velazquez, Yorba Linda, CA (US)

(73) Assignee: American DJ Supply, Inc., Los Angeles, CA (US)

( * ) Notice: Subject to any disclaimer, the term of this patent is extended or adjusted under 35 U.S.C. 154(b) by 436 days.

(21) Appl. No.: 13/554,756

(22) Filed: Jul. 20, 2012

(65) Prior Publication Data

US 2013/0027934 A1 Jan. 31, 2013

Related U.S. Application Data

(60) Provisional application No. 61/512,336, filed on Jul. 27, 2011.

(51) Int. Cl.

| | |
|---|---|
| ***F21S 4/00*** | (2006.01) |
| ***F21V 23/06*** | (2006.01) |
| ***F21V 23/00*** | (2015.01) |
| *F21V 21/30* | (2006.01) |
| *H05B 37/02* | (2006.01) |

(52) U.S. Cl.

CPC ..... *F21V 23/06* (2013.01); *F21V 23/009* (2013.01); *F21V 21/30* (2013.01); *H05B 37/0254* (2013.01); *H05B 37/0272* (2013.01)

(58) Field of Classification Search

CPC ..... F21V 21/005; F21V 21/145; F21V 21/30; F21V 23/009; F21V 23/06; H05B 37/0254; H05B 37/0263; H05B 37/0272; H05B 37/029

USPC ..... 362/232, 233, 234, 249.01, 249.07, 362/249.1, 362, 395

See application file for complete search history.

(56) References Cited

U.S. PATENT DOCUMENTS

| | | | | |
|---|---|---|---|---|
| 6,213,626 | B1 * | 4/2001 | Qian | 362/410 |
| 6,548,967 | B1 | 4/2003 | Dowling et al. | |
| D486,259 | S | 2/2004 | Crawford et al. | |
| D552,782 | S | 10/2007 | Korpi | |
| D573,286 | S | 7/2008 | Zettl | |
| D606,691 | S | 12/2009 | Lindholm | |
| 8,187,006 | B2 | 5/2012 | Rudisill et al. | |

(Continued)

FOREIGN PATENT DOCUMENTS

| | | | |
|---|---|---|---|
| DE | 202009013348 | U1 | 1/2010 |
| DE | 202011005471 | U1 | 10/2011 |

(Continued)

OTHER PUBLICATIONS

U.S. Notice of Allowance for U.S. Appl. No. 29/444,239 mailed Jun. 11, 2013.

(Continued)

*Primary Examiner* — Y M Lee

(74) *Attorney, Agent, or Firm* — Sherman IP LLP; Kenneth L. Sherman; Hemavathy Perumal

(57) ABSTRACT

Embodiments of the present invention provide a lighting apparatus comprising a housing for maintaining a lighting frame. The housing comprises at least one supporting wall, a first side wall, and a second side wall that is substantially parallel to the first side wall. The side walls are transverse to a supporting wall of the housing. The first side wall includes at least one input socket for receiving input electronic signals. The second side wall includes at least one output socket for transmitting output electronic signals.

27 Claims, 19 Drawing Sheets

(56) References Cited

U.S. PATENT DOCUMENTS

| | | | | |
|---|---|---|---|---|
| D667,582 | S | 9/2012 | Toft | |
| 8,283,874 | B2 | 10/2012 | Buelow, II et al. | |
| 2005/0116667 | A1 | 6/2005 | Mueller et al. | |
| 2005/0141219 | A1* | 6/2005 | Skegin | 362/240 |
| 2006/0046613 | A1* | 3/2006 | Mann | 446/475 |
| 2006/0134978 | A1 | 6/2006 | Rosen et al. | |
| 2007/0229250 | A1 | 10/2007 | Recker et al. | |
| 2008/0062685 | A1* | 3/2008 | Belliveau et al. | 362/233 |
| 2008/0278932 | A1 | 11/2008 | Tress | |
| 2009/0066266 | A1 | 3/2009 | Jungwirth et al. | |
| 2009/0239393 | A1 | 9/2009 | Shah et al. | |
| 2011/0013395 | A1* | 1/2011 | Melzner et al. | 362/249.01 |
| 2011/0110085 | A1 | 5/2011 | Tickner et al. | |
| 2011/0164421 | A1 | 7/2011 | Velazquez | |
| 2011/0181494 | A1 | 7/2011 | Wong et al. | |
| 2012/0224373 | A1 | 9/2012 | Snijder et al. | |
| 2013/0122724 | A1 | 5/2013 | Velazquez | |

FOREIGN PATENT DOCUMENTS

| | | | |
|---|---|---|---|
| GB | 2465339 | A | 5/2010 |
| WO | 2009047769 | A2 | 4/2009 |
| WO | 2009064305 | A2 | 5/2009 |
| WO | 2011058486 | A2 | 5/2011 |

OTHER PUBLICATIONS

Extended European Search Report dated Aug. 4, 2014 for European Application No. 12177507.6 from European Patent Office, pp. 1-7, Munich, Germany.

International Search Report and the Written Opinion mailed Feb. 5, 2013 for International Application No. PCT/US2012/065082 from the International Searching Authority and United States Commissioner for Patents, 8 pages, Alexandria, Virginia, United States.

International Search Report and the Written Opinion mailed Mar. 8, 2013 for International Application No. PCT/US2012/071499 from the International Searching Authority and United States Commissioner for Patents, 10 pages, Alexandria, Virginia, United States.

U.S. Non-Final Office Action for U.S. Appl. No. 13/670,400 mailed Nov. 25, 2014.

U.S. Final Office Action for U.S. Appl. No. 13/670,400 mailed Apr. 14, 2015.

Extended European Search Report dated Jun. 15, 2015 for European Application No. 12850105.3 from European Patent Office, pp. 1-8, Munich, Germany.

U.S. Advisory Action for U.S. Appl. No. 13/670,400 mailed Jul. 2, 2015.

U.S. Non-Final Office Action for U.S. Appl. No. 13/670,400 mailed Aug. 11, 2015.

* cited by examiner

100

100

100

100

100

100

100

DMX CONTROLLABLE LOW PROFILE LIGHTING APPARATUS

CROSS REFERENCE TO RELATED APPLICATIONS

This application claims priority from U.S. Provisional Patent Application Ser. No. 61/512,336, filed on Jul. 27, 2011, incorporated herein by reference.

BACKGROUND OF THE INVENTION

1. Field of the Invention

The present invention relates generally to lighting apparatuses, and in particular, to a Digital Multiplex (DMX) controllable low profile lighting apparatus.

2. Description of Related Art

Lighting apparatuses are used for illuminating both indoor and outdoor environments. Proper illumination is vital when filming movies, television shows, shooting videos, taking photographs, lighting live stage performances, and other similar activities.

BRIEF SUMMARY OF THE INVENTION

Embodiments of the present invention provide a lighting apparatus comprising a housing for maintaining a lighting frame. The housing comprises at least one supporting wall, a first side wall, and a second side wall that is substantially parallel to the first side wall. The side walls are transverse to a supporting wall of the housing. The first side wall includes at least one input socket for receiving input electronic signals. The second side wall includes at least one output socket for transmitting output electronic signals.

In another embodiment, the present invention provides a lighting system comprising a plurality of lighting apparatuses. Each lighting apparatus comprises a housing for maintaining a lighting frame of said lighting apparatus. The housing of each lighting apparatus comprises at least one supporting wall, a first side wall, and a second side wall that is substantially parallel to the first side wall. The side walls are transverse to a supporting wall of the housing. The first side wall includes at least one input socket for receiving input electronic signals. The second side wall includes at least one output socket for transmitting output electronic signals.

In yet another embodiment, the present invention provides a housing for maintaining a lighting frame of a lighting apparatus. The housing comprises at least one supporting wall, a first side wall, and a second side wall that is substantially parallel to the first side wall. The side walls are transverse to a supporting wall of the housing. The first side wall includes at least one input socket for receiving input electronic signals. The second side wall includes at least one output socket for transmitting output electronic signals.

These and other features, aspects and advantages of the present invention will become understood with reference to the following description, appended claims and accompanying figures.

DETAILED DESCRIPTION OF THE INVENTION

Figure 1:
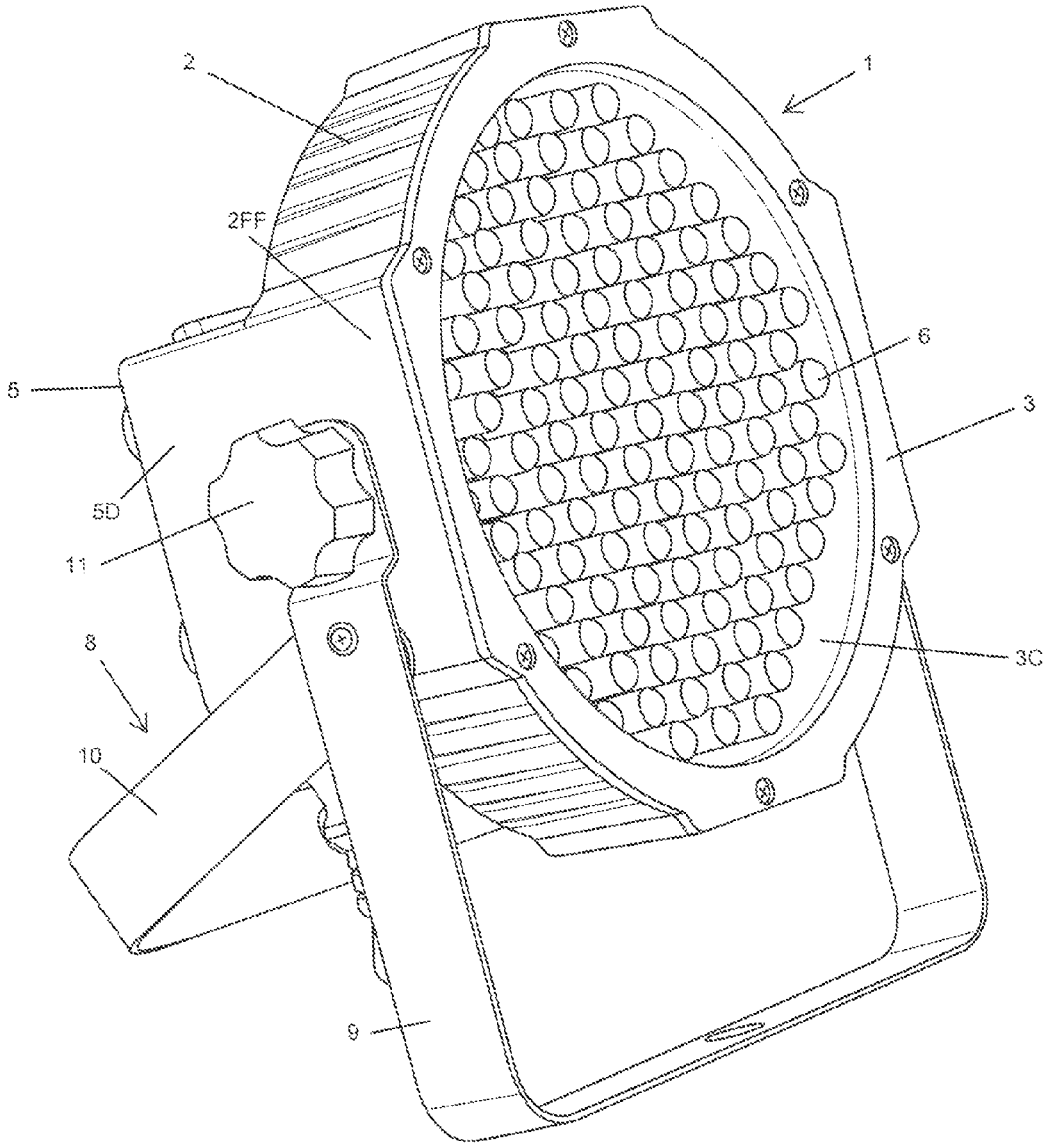
FIG. 1 illustrates a front perspective view of a lighting apparatus, in accordance with an embodiment of the present invention.

Embodiments of the present invention provide a lighting apparatus comprising a housing for maintaining a lighting frame. The housing comprises at least one supporting wall, a first side wall, and a second side wall that is substantially parallel to the first side wall. The side walls are transverse to a supporting wall of the housing. The first side wall includes at least one input socket for receiving input electronic signals. The second side wall includes at least one output socket for transmitting output electronic signals.

In another embodiment, the present invention provides a lighting system comprising a plurality of lighting apparatuses. Each lighting apparatus comprises a housing for maintaining a lighting frame of said lighting apparatus. The housing of each lighting apparatus comprises at least one supporting wall, a first side wall, and a second side wall that is substantially parallel to the first side wall. The side walls are transverse to a supporting wall of the housing. The first side wall includes at least one input socket for receiving input electronic signals. The second side wall includes at least one output socket for transmitting output electronic signals.

In yet another embodiment, the present invention provides a housing for maintaining a lighting frame of a lighting apparatus. The housing comprises at least one supporting wall, a first side wall, and a second side wall that is substantially parallel to the first side wall. The side walls are transverse to a supporting wall of the housing. The first side wall includes at least one input socket for receiving input electronic signals. The second side wall includes at least one output socket for transmitting output electronic signals.

The lighting frame includes a plurality of lighting elements. The first side wall includes a power input socket for receiving power, and a data input connector for receiving data control signals. The second side wall includes a power output socket for transmitting power, and a data output connector for transmitting data control signals.

The lighting apparatus includes a first supporting wall. The first supporting wall extends transversely between the first side wall and the second side wall. The first supporting wall includes multiple support members that stabilize and support the lighting apparatus when the lighting apparatus is positioned to sit flat on a surface. The first supporting wall further includes an LCD display screen, and a plurality of manual control buttons. An operator can utilize the LCD display screen and the manual control buttons to control the lighting effects of the lighting elements.

The housing further comprises a control module for controlling the lighting elements, wherein the control module comprises a plurality of drivers. The plurality of drivers includes a lighting driver for controlling the lighting effects of the lighting elements.

The data input connector of the first side wall receives data control signals from a controller. In one embodiment, the controller is a Digital Multiplex (DMX) controller. The received data control signals include DMX data instructions.

The lighting apparatus further comprises a wireless DMX module for wirelessly receiving data control signals including DMX data instructions from a wireless DMX controller.

The lighting apparatus further comprises a detachable dual mounting bracket for mounting the lighting apparatus to one of the following supporting surfaces or structures: a floor stand, a wall, a lighting grid, a ceiling, and a truss.

The lighting apparatus further includes a pair of opposing flat portions as supporting walls. The lighting apparatus may be positioned to sit sideways by resting a flat portion on a surface.

FIG. 1 illustrates a front perspective view of a lighting apparatus 100, in accordance with an embodiment of the present invention. The lighting apparatus 100 comprises a lightweight lighting frame 1, and a housing 5 for maintaining the lighting frame 1.

The lighting frame 1 comprises a lighting panel 2. The shape of the lighting panel 2 may vary. In one embodiment, the lighting panel 2 is substantially circular-shaped. A plurality of lighting elements 6 are affixed to the lighting panel 2. The lighting elements 6 may comprise, for example, semiconductor LEDs or organic LEDs. Other light emitting elements, such as light bulbs, lasers, or liquid crystal display (LCD) panels, may also be used.

The arrangement of the lighting elements 6 on the lighting panel 2 may vary. In one embodiment, the lighting elements 6 on the lighting panel 2 are spaced closely, as shown in FIG. 1.

In one embodiment, the lighting frame 1 further comprises a cover plate 3 that is fixedly but removably secured to the lighting panel 2 to protect the lighting elements 6. The cover plate 3 may include a transparent/translucent lens 3C through which light from the lighting elements 6 can illuminate.

The lighting apparatus 100 has a low profile design. The housing 5 extends rearwardly from the lighting panel 2. The housing 5 has a plurality of walls, such as a first side wall 5A (FIG. 2), a second side wall 5B (FIG. 3), a first supporting wall 5C (FIG. 4), and a pair of opposing side walls 5D. The housing 5 may further comprise a first pair of opposing flat portions 2F (FIG. 2), and a second pair of opposing flat portions 2FF. In one embodiment, the first pair of opposing flat portions 2F are additional supporting walls.

The housing 5 further includes a control module 104 (FIG. 5) disposed inside the housing 5. As described in detail later herein, the control module 104 includes circuits for controlling the lighting effect functions of the lighting apparatus 100, such as, for example, dimming, strobing, selective activation, pulsation, color temperature, and so on.

Figure 6A:
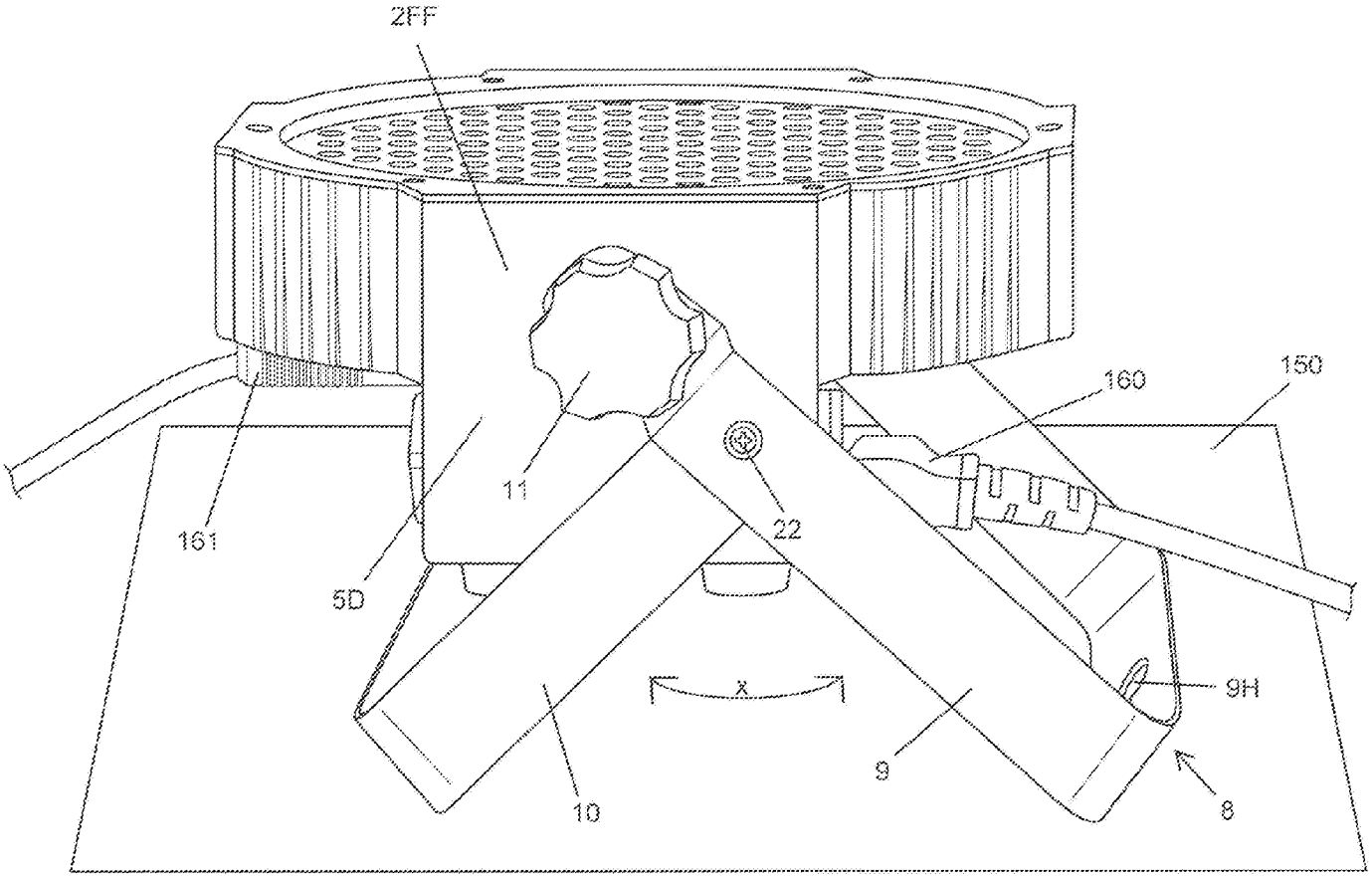
FIG. 6A illustrates a side view of an lighting apparatus, wherein a detachable dual mounting bracket of the lighting apparatus is used to position the lighting apparatus to stand on a supporting surface, in accordance with an embodiment of the invention.

The lighting apparatus 100 further comprises a detachable dual mounting bracket 8 (e.g., double yoke) for mounting the lighting apparatus 100 to a floor stand or a wall, hanging the lighting apparatus 100 in a lighting grid or a truss, or positioning the lighting apparatus 100 to stand on a ground or a supporting surface 150 (FIG. 6A). As later described in detail herein, a first and a second rotatable knob 11 secure the mounting bracket 8 to opposing flat portions 2FF of the housing 5. The knobs 11 can be rotated to tilt the lighting panel 2 and the housing 5 about a substantially ninety degree angle to a desired orientation.

Figure 10:
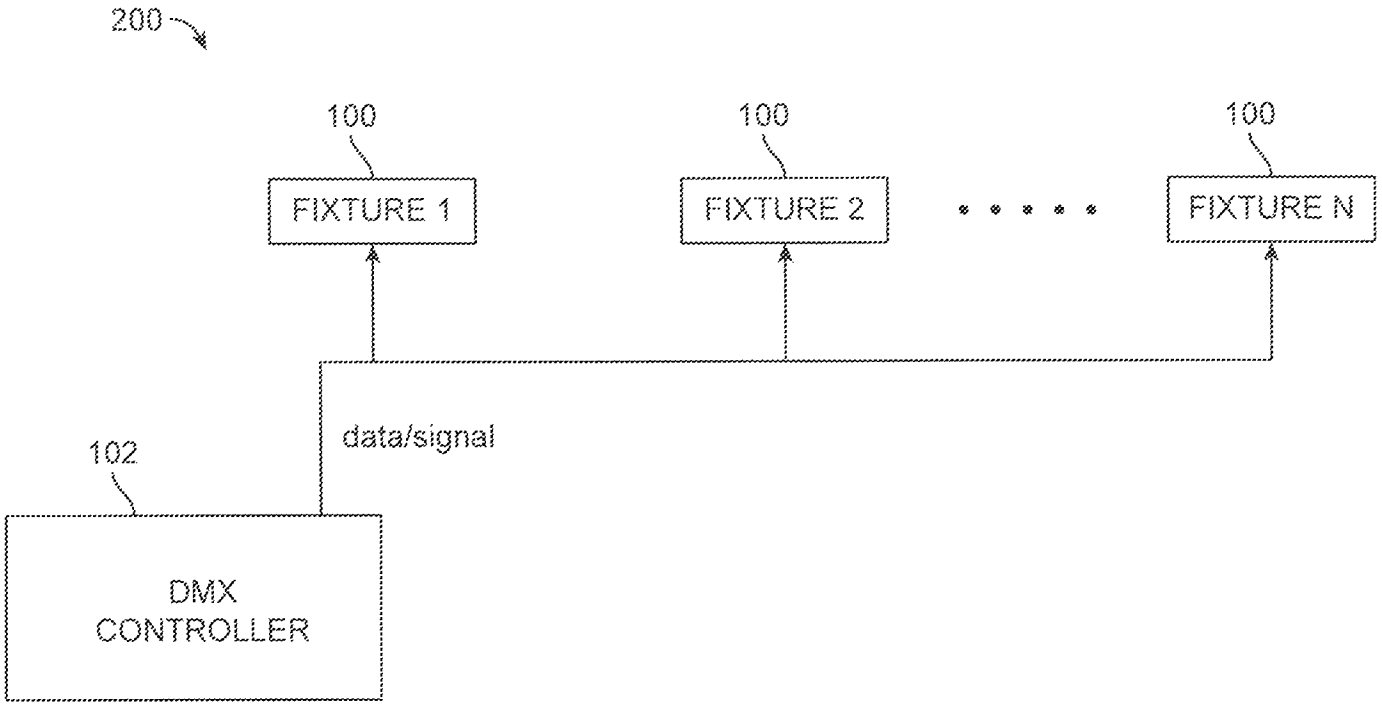
FIG. 10 is a block diagram illustrating multiple lighting apparatuses arranged in a parallel video capture circuit, in accordance with an embodiment of the invention.
Figure 11:
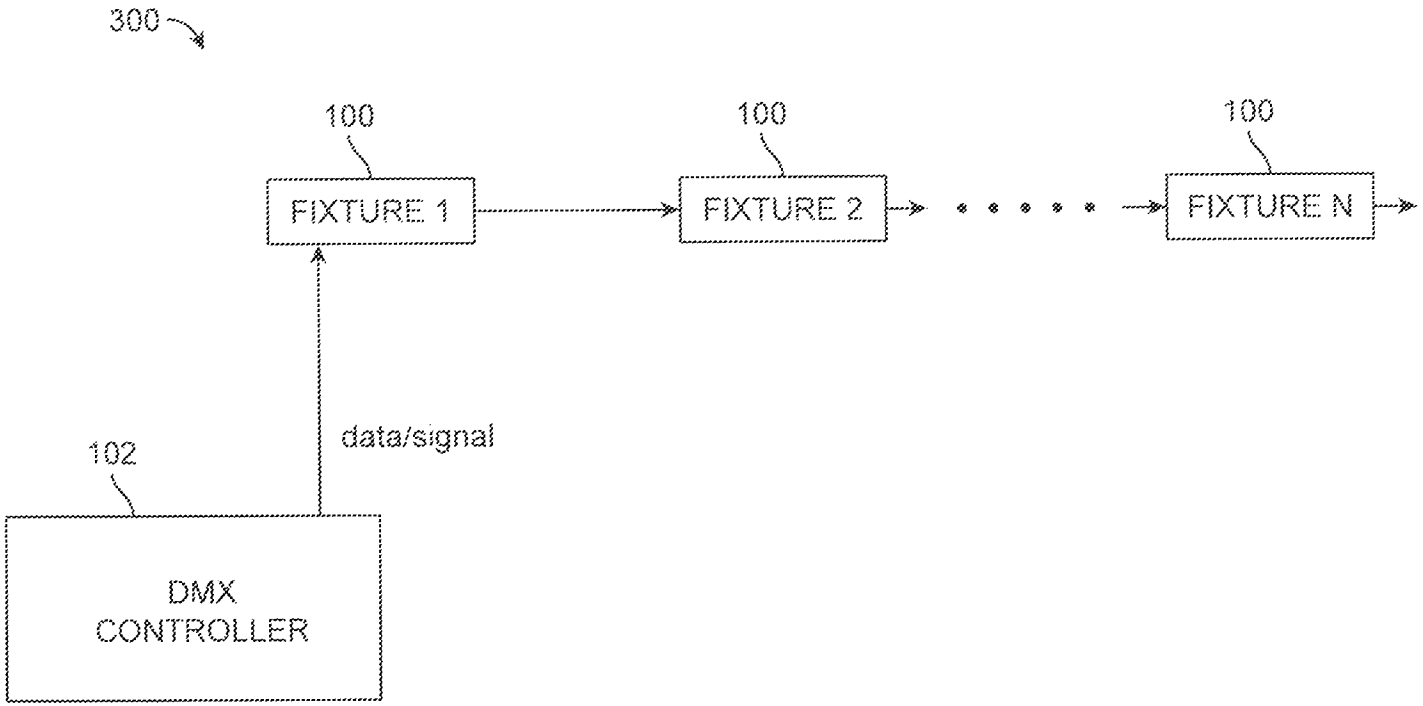
FIG. 11 is a block diagram illustrating multiple lighting apparatuses linked in a daisy-chain video capture circuit, in accordance with an embodiment of the invention.

The lighting apparatus 100 can be used as a stand alone, in multiples such as in a parallel video capture circuit 200 (FIG. 10), or linked in a master/slave configuration such as a daisy-chain (i.e., serial) video capture circuit 300 (FIG. 11).

Figure 2:
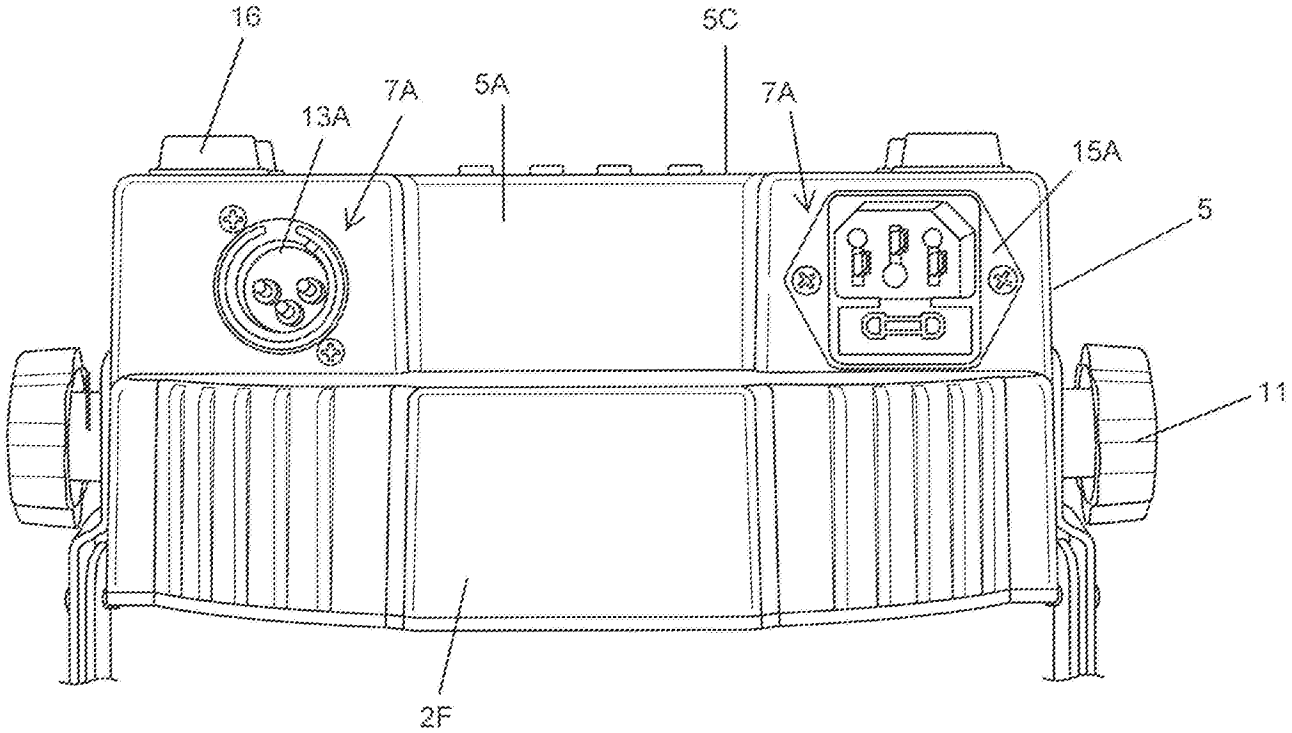
FIG. 2 illustrates a side view of a lighting apparatus, in accordance with an embodiment of the present invention.

FIG. 2 illustrates a side view of a lighting apparatus 100, in accordance with an embodiment of the present invention. The first side wall 5A of the housing 5 extends rearwardly from the lighting panel 2 (FIG. 1). The first side wall 5A includes at least one input socket 7A for receiving input electronic signals. In one embodiment, the first side wall 5A may comprise the following input sockets 7A: a power input socket 15A for receiving power from a power supply source (e.g., a power outlet, another lighting apparatus 100), and a data input connector 13A for receiving data control signals.

In one example implementation, the data input connector 13A is a 3-pin Digital Multiplex (DMX) input connector. In another example implementation, the data input connector 13A is a 5-pin DMX input connector. The data input connector 13A may receive DMX data instructions from a DMX controller 102 or another lighting apparatus 100.

Figure 3:
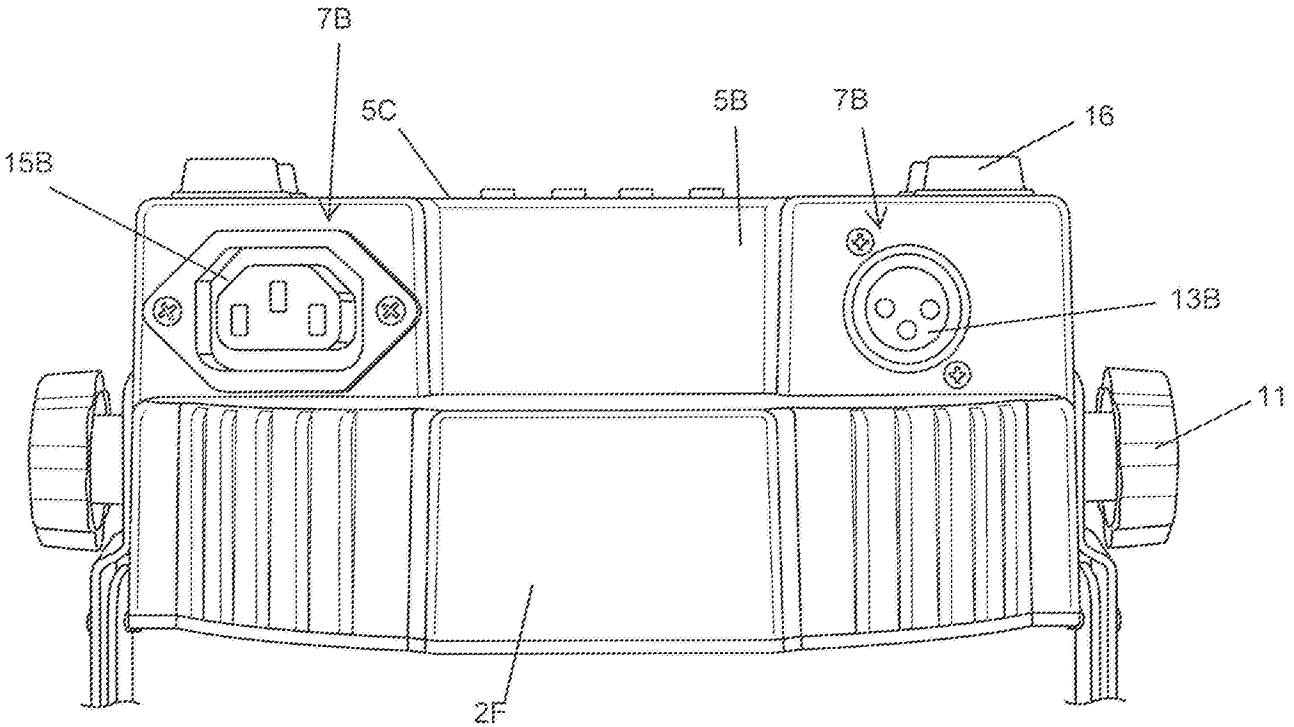
FIG. 3 illustrates an alternate side view of a lighting apparatus, in accordance with an embodiment of the present invention.

FIG. 3 illustrates an alternate side view of a lighting apparatus 100, in accordance with an embodiment of the present invention. The second side wall 5B of the housing 5 extends rearwardly from the lighting panel 2. The second side wall 5B is substantially parallel to the first side wall 5A (FIG. 2) of the housing 5. The second side wall 5B includes at least one output socket 7B for transmitting output. In one embodiment, the second side wall 5B may comprise the following output sockets 7B: a power output socket 15B for transmitting power to another lighting apparatus 100, and a data output connector 13B for transmitting data control signals.

In one example implementation, the data output connector 13B is a 3-pin DMX output connector. In another example implementation, the data output connector 13B is a 5-pin DMX output connector. The data output connector 13B may be used to transmit an outgoing DMX master/slave signal to another lighting apparatus 100.

Positioning the input sockets 7A and the output sockets 7B on the first side wall 5A and the second side wall 5B, respectively, facilitates the linking of the lighting apparatus 100 linked in a daisy-chain video capture circuit 300 (FIG. 11).

Figure 4:
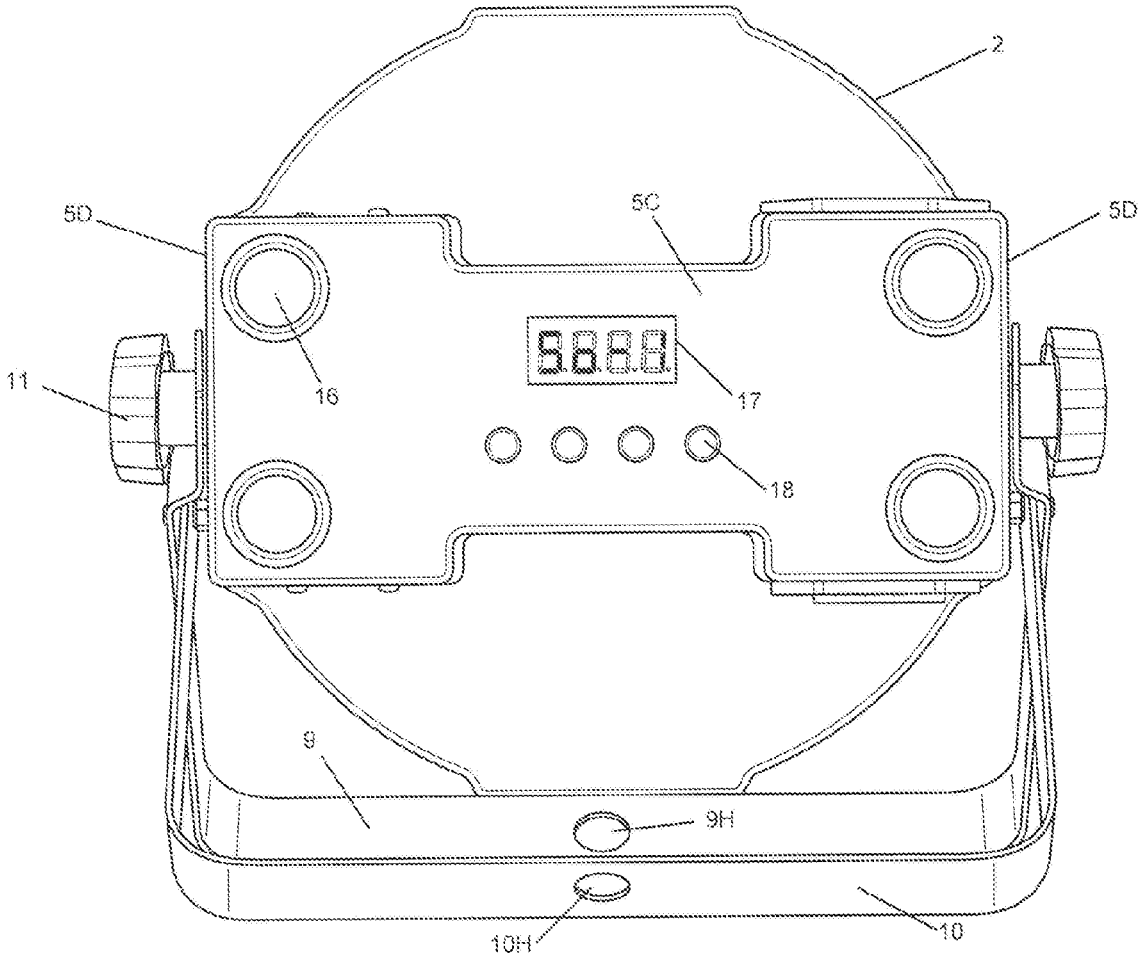
FIG. 4 illustrates a rear view of a lighting apparatus, in accordance with an embodiment of the present invention.

FIG. 4 illustrates a rear view of a lighting apparatus 100, in accordance with an embodiment of the present invention. The first supporting wall 5C of the housing 5 extends transversely between the first side wall 5A (FIG. 2) and the second side wall 5B (FIG. 3) of the housing 5 (FIG. 1). The first supporting wall 5C also extends transversely between the opposing side walls 5D of the housing 5.

The first supporting wall 5C comprises an LCD menu control panel 17 and multiple manual control buttons 18. An operator may utilize the LCD menu control panel 17 and the manual control buttons 18 to display and control the lighting effect functions of the lighting apparatus 100, such as, for example, dimming, strobing, selective activation, pulsation, color temperature, and so on. An operator may also utilize the LCD menu control panel 17 and the manual control buttons 18 to set and display a DMX address for the lighting apparatus 100.

The first supporting wall 5C further comprises support members 16 (e.g., built-in feet) that are distributed evenly on the first supporting wall 5C to stabilize and support the lighting apparatus 100 when the lighting apparatus 100 is positioned to sit flat on a supporting surface 150.

Figure 5:
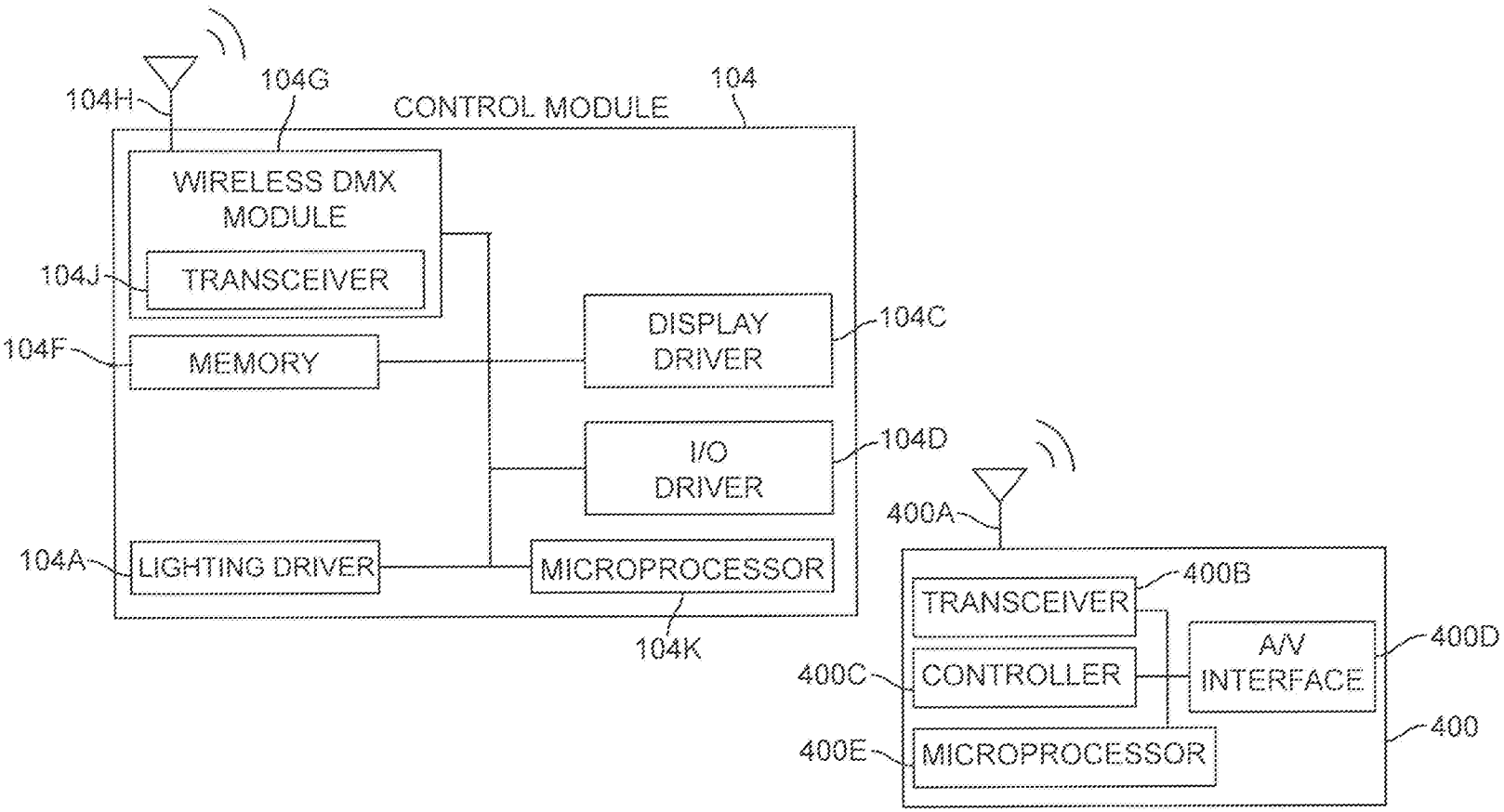
FIG. 5 is a block diagram illustrating a control module of a LED lighting apparatus, in accordance with an embodiment of the present invention.

FIG. 5 is a block diagram illustrating a control module 104 of a LED lighting apparatus 100, in accordance with an embodiment of the invention. As stated above, the control module 104 is disposed inside the housing 5 (FIG. 1). The control module 104 comprises a plurality of drivers, such as a lighting driver 104A, a display driver 104C, a power/data input/output (I/O) driver 104D, a wireless DMX module 104G, a memory unit 104F, and a microprocessor 104K.

The lighting driver 104A controls the lighting effects of the lighting elements 6. For example, the lighting driver 104A can selectively turn on or turn off each lighting element 6. The lighting driver 104A can also selectively adjust the color temperature or brightness of each lighting element 6.

The display driver 104C controls the LCD display screen 17. The power/data I/O driver 104D controls the input sockets 7A and the output sockets 7B. The microprocessor 104K is configured to process the data control signals received. The memory unit 104F maintains information such as the DMX address of the lighting apparatus 100.

The wireless DMX module 104G is configured to wirelessly communicate/exchange information (e.g., data control signals) with a wireless DMX controller 400. In one embodiment, the wireless DMX module 104G operates on one or more radio frequencies. The wireless DMX module 104G includes an antenna 104H and a wireless transceiver 104J. The antenna 104H and the transceiver 104J are configured to wirelessly receive radio frequency (RF) signals from, and wirelessly transmit RF signals to, a wireless transceiver 400B of a wireless DMX controller 400. The RF signals received include data control signals such as DMX signals. In another embodiment, the antenna 104H and the transceiver 104J wirelessly exchange information (e.g., data control signals) with a wireless DMX controller 400 using infrared (I/R) waves.

As shown in FIG. 5, a wireless DMX controller 400 comprises an antenna 400A, a wireless transceiver 400B, a controller 400C, a microprocessor 400E, and an A/V interface 400D. The A/V interface 400D of the wireless DMX controller 400 may comprise a graphic display, and alphanumeric and directional keypads that an operator can use to enter input commands. The A/V interface 400D may comprise other types of electronic or manual data input means. The microprocessor 400E of the remote wireless DMX controller 400 is configured to process the input commands entered and generate the appropriate data control signals. The controller 400C of the wireless DMX controller 400 is configured to generate RF signals including the data controls signals generated.

The antenna 400A and the transceiver 400B of the wireless DMX controller 400 are configured to wirelessly communicate/exchange information (e.g., data control signals) with the wireless DMX module 104G of the control module 104. In one embodiment, the antenna 400A and the transceiver 400B operate on one or more radio frequencies. The antenna 400A and the transceiver 400B wirelessly receive RF signals from, and wirelessly transmit RF signals to, the wireless DMX module 104G. In another embodiment, the antenna 400A and the transceiver 400B wirelessly exchange information (e.g., data control signals) with the wireless DMX module 104G using infrared (I/R) waves.

FIG. 6A illustrates a side view of a lighting apparatus 100, wherein a detachable dual mounting bracket 8 of the lighting apparatus 100 is used to position the lighting apparatus 100 to stand on a supporting surface 150, in accordance with an embodiment of the present invention. The mounting bracket 8 allows the lighting apparatus 100 to be mounted onto a floor stand or a wall, hung in a lighting grid or a truss, or positioned to stand on a ground or a supporting surface 150. The mounting bracket 8 comprises a first substantially U-shaped bracket 9 and a second substantially U-shaped bracket 10. The brackets 9 and 10 may be made of rigid materials such as metals and the like.

In one embodiment, the first bracket 9 is detachably affixed via rotatable knobs 11 to the opposing flat portions 2FF of the housing 5. The second bracket 10 is permanently affixed via pivot fasteners such as pivot screws 22 to the first bracket 9. In one example, the second bracket 10 may be pivoted about a rotation angle x relative to the first bracket 9. The rotation angle x may be a substantially ninety degree rotation angle relative to the first bracket 9. Other rotation angles are also possible.

As shown in FIG. 6A, a power input cord 160 is connected to the power input socket 15A (FIG. 2) of the housing 5 (FIG. 1) to receive power from a power supply source (e.g., a power outlet, another lighting apparatus 100). A power output cord 161 is connected to the power output socket 15B (FIG. 3) of the housing 5 to transmit power to another lighting apparatus 100.

Figure 6B:
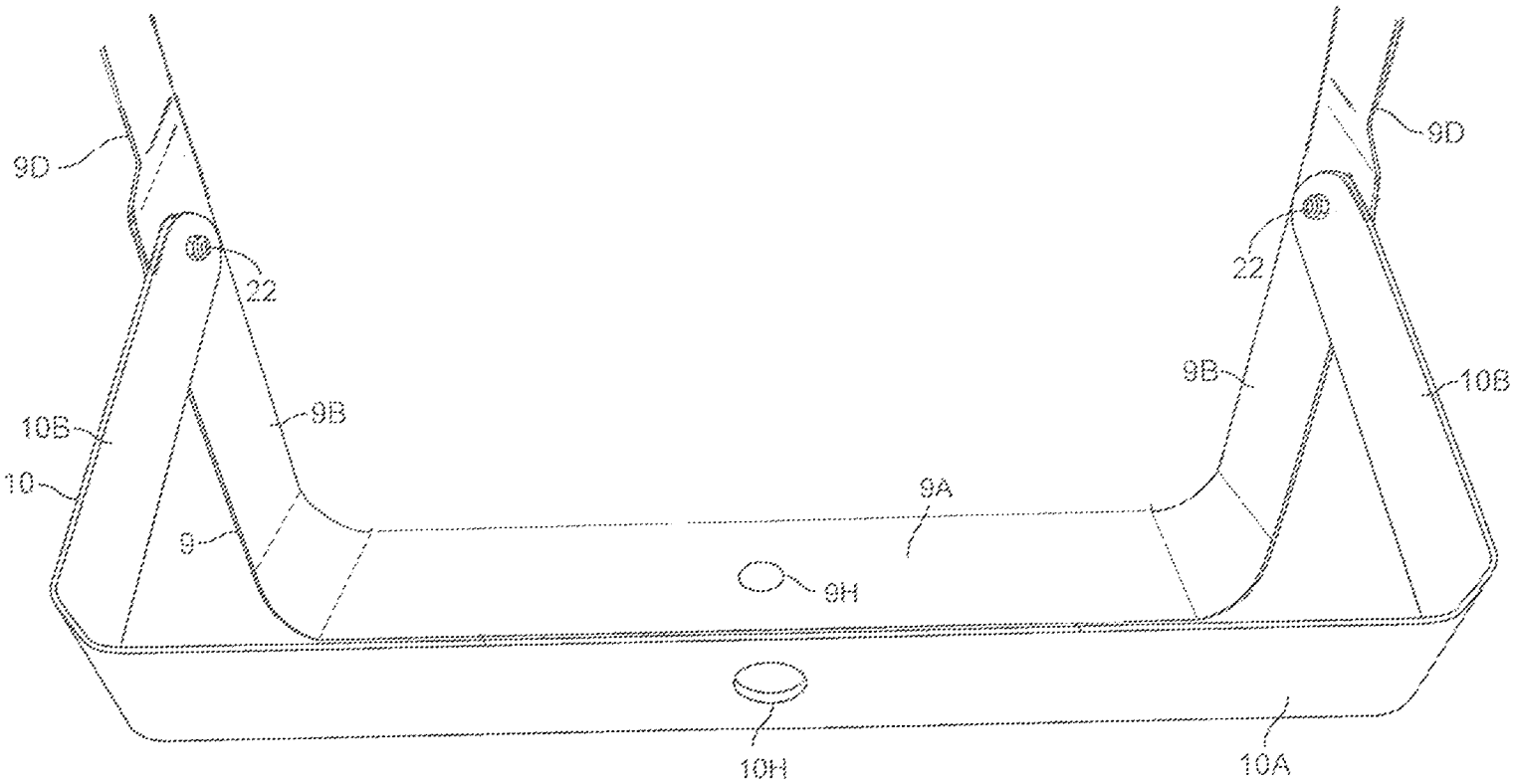
FIG. 6B illustrates a back perspective view of a detachable dual mounting bracket for a lighting apparatus, in accordance with an embodiment of the present invention.

FIG. 6B illustrates a back perspective view of a detachable dual mounting bracket 8 for a lighting apparatus 100, in accordance with an embodiment of the present invention. As described above, the dual mounting bracket 8 comprises the first substantially U-shaped bracket 9 and the second substantially U-shaped bracket 10.

The first bracket 9 comprises opposed first and second substantially rectangular planar legs 9B. The first bracket 9 further comprises a substantially rectangular planar elongate member 9A connecting the first and second legs 9B. Each leg 9B is disposed transverse (e.g., substantially perpendicular) to the elongate member 9A such that the legs 9B extend substantially parallel to each other. The legs 9B are integrally formed with the elongate member 9A.

The first bracket 9 further comprises opposed first and second flanges 9D. The first and second flanges 9D are integrally formed with the first and second legs 9B, respectively. The first bracket 9 of the dual mounting bracket 8 is detachably affixed to the housing 5 of the lighting apparatus. As described in detail later herein, a first and a second rotatable knob 11 (FIG. 7) secure the first and second flanges 9D to the opposing flat portions 2FF of the housing 5.

The second bracket 10 comprises opposed first and second substantially rectangular planar legs 10B. The second bracket 10 further comprises a substantially rectangular planar elongate member 10A connecting the first and second legs 10B. Each leg 10B is disposed transverse (e.g., substantially perpendicular) to the elongate member 10A such that the legs 10B extend substantially parallel to each other. The legs 10B are integrally formed with the elongate member 10A.

A distal end of the first leg 10B is permanently affixed via a pivot screw 22 to the distal end of the first leg 9B. A distal end of the second leg 10B is permanently affixed via a pivot screw 22 to the distal end of the second leg 9B. The pivot screws 22 allow the second bracket 10 to pivot about a substantially ninety degree angle relative to the first bracket 9.

The first bracket 9 is shaped to receive the second bracket 10 when the brackets 9 and 10 are aligned. Specifically, the length of the elongate member 10A is smaller than the length of the elongate member 9A, and the height of the legs 10B is smaller than the height of the legs 9B. These differences in physical dimension allow for the second bracket 10 to be fitted between the legs 9B of the first bracket 9 when the brackets 9 and 10 are aligned.

The elongate member 9A of the first bracket 9 comprises a center hole 9H disposed at a center of the elongate member 9A. The elongate member 10A of the second bracket 10 comprises a center hole 10H disposed at a center of the elongate member 10A. The center holes 9H and 10H are positioned such that when the brackets 9 and 10 are aligned, the center holes 9H and 10H are also aligned. A fastener can then be inserted through the aligned center holes 9H and 10H to secure the lighting apparatus 100 to a floor stand, a wall, a lighting grid, a truss, a ground, or a surface. The fastener may be a screw, a bolt, a stud, or the like.

Figure 7:
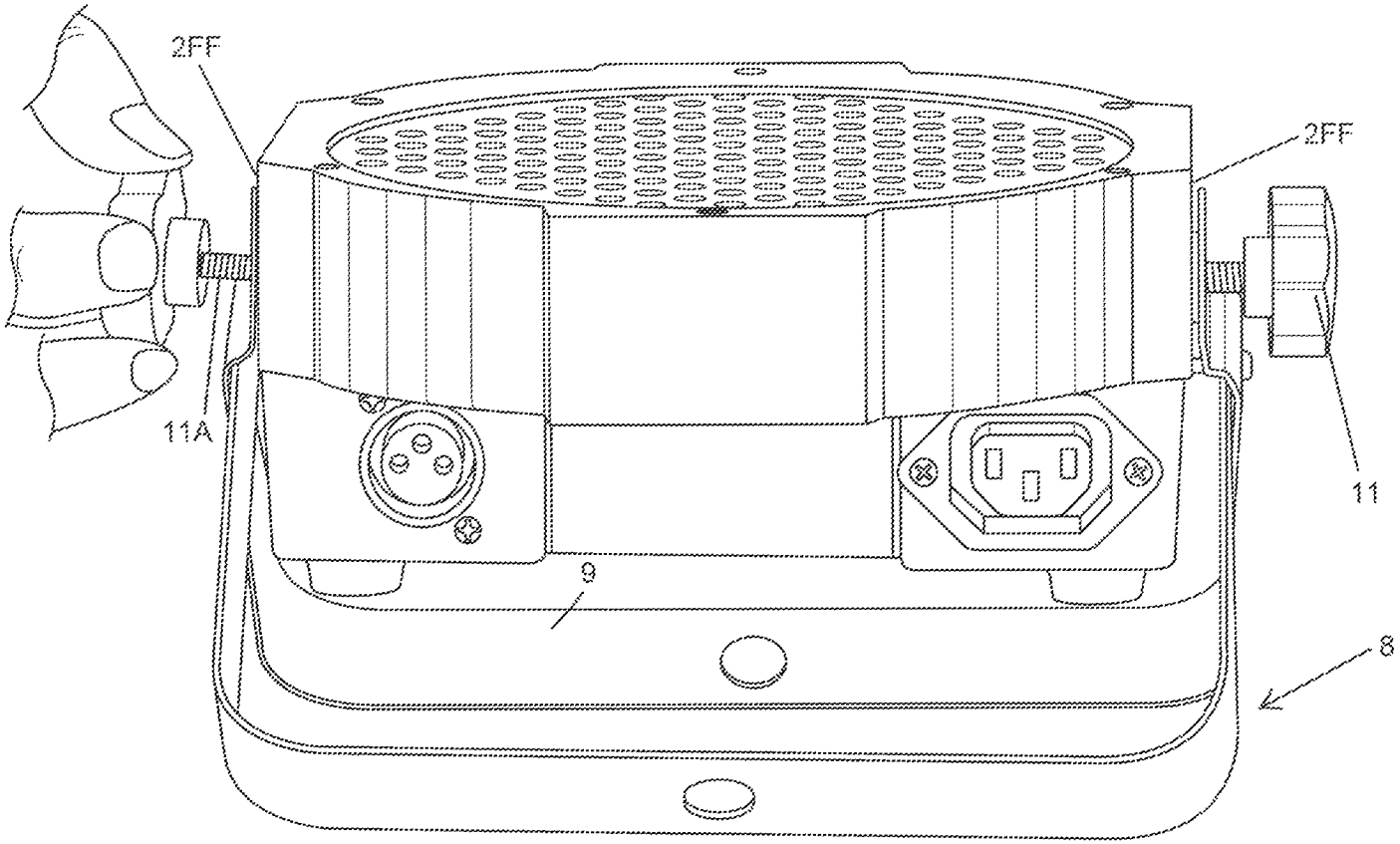
FIG. 7 illustrates a side view of the lighting apparatus, wherein rotatable knobs of the lighting apparatus are rotated to detach a dual mounting bracket of the lighting apparatus, in accordance with an embodiment of the present invention.

FIG. 7 illustrates a side view of the lighting apparatus 100, wherein rotatable knobs 11 of the lighting apparatus 100 are rotated to detach a dual mounting bracket 8 of the lighting apparatus 100, in accordance with an embodiment of the present invention.

A first and a second rotatable knob 11 secure the first bracket 9 to the opposing flat portions 2FF of the housing 5 (FIG. 1). Each knob 11 includes a screw 11A. Each flange 9D (FIG. 6B) of the first bracket 9 includes an aperture 9HH (FIG. 13B) for receiving the screw 11A. Each opposing flat portion 2FF includes an aperture 2H (FIG. 8) for receiving the screw 11A of a knob 11. The screw 11A of the first rotatable knob 11 is inserted through the aperture 9HH of the first flange 9D and inside the aperture 2H of the first opposing flat portion 2FF to attach the first flange 9D to the housing 5. The screw 11A of the second rotatable knob 11 is inserted through the aperture 9HH of the second flange 9D and inside the aperture 2H of the second opposing flat portion 2FF to attach the second flange 9D to the housing 5.

The knobs 11 can be rotated to tilt the lighting panel 2 (FIG. 1) and the housing 5 (FIG. 1) about a substantially ninety degree angle to a desired orientation. Each knob 11 can be rotated in a first direction (e.g., counter-clockwise) to tighten the screw 11A of said knob 11 inside a corresponding hole 2H of the lighting panel 2. Rotating a knob 11 in the first direction decreases the rotary movement of the knob 11 until the knob 11 is prevented from rotating further, thereby locking the orientation of the lighting panel 2 and the housing 5.

Each rotatable knob 11 can also be rotated in a second direction (e.g., clockwise) to unlock the lighting panel 2 and the housing 5 from its current orientation, thereby allowing the lighting panel 2 and the housing 5 to tilt. Rotating a knob 11 in the second direction loosens the screw 11A of the knob 11 from a corresponding hole 2H, thereby increasing the rotary movement of the knob 11 until the screw 11A of the knob 11 is unscrewed from the corresponding hole 2H.

Unscrewing both the first and second knobs 11 from the lighting panel 2 loosens the first bracket 9 from the lighting panel 2. The dual mounting bracket 8 is detached from the lighting apparatus 100 when both the first and second knobs 11 are detached from the opposing flat portions 2FF.

Figure 8:
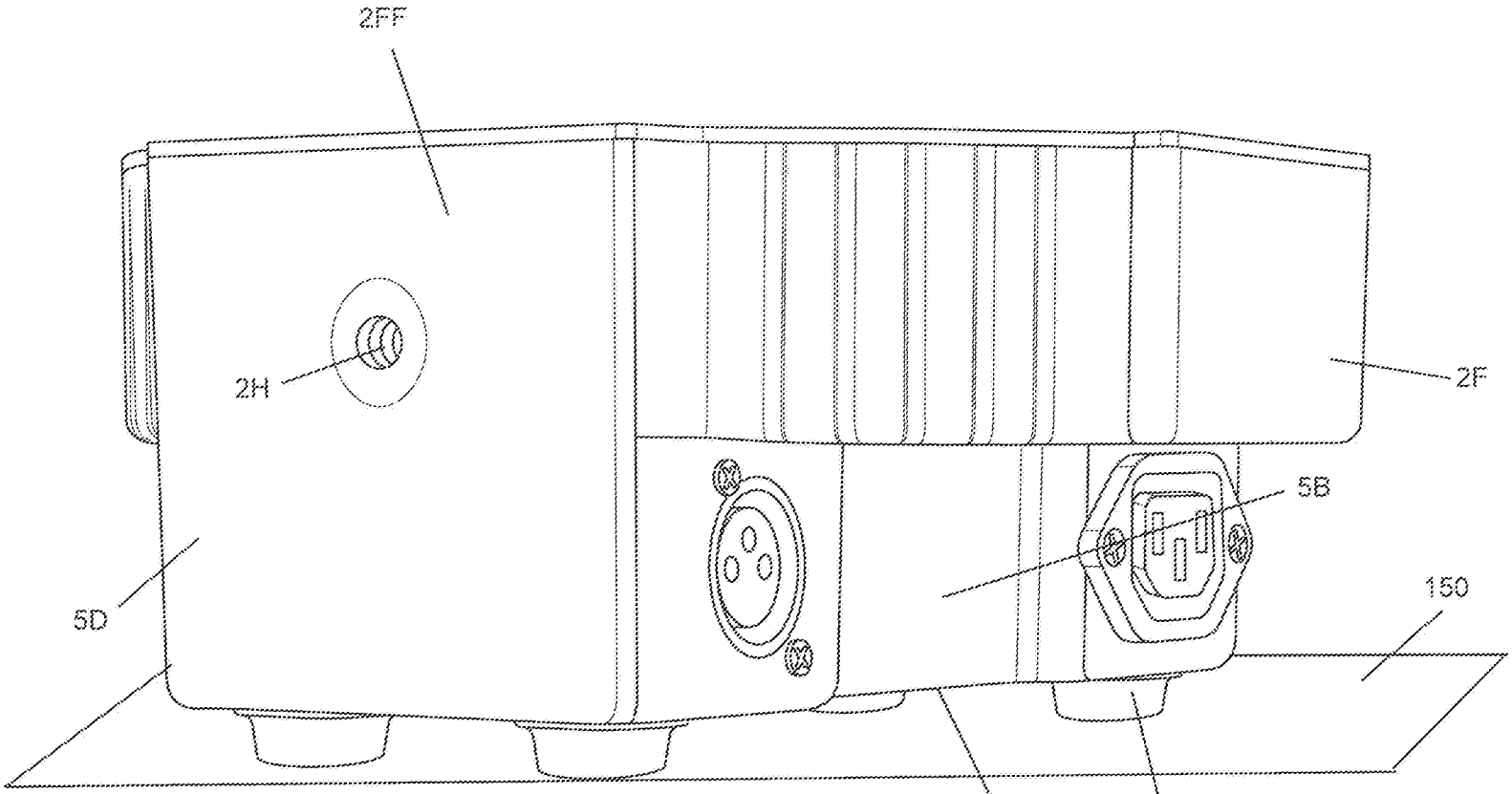
FIG. 8 illustrates a side view of a lighting apparatus, wherein the lighting apparatus is positioned to sit flat on a supporting surface, in accordance with an embodiment of the present invention.

FIG. 8 illustrates a side view of the lighting apparatus 100, wherein the lighting apparatus 100 is positioned to sit flat on a supporting surface 150, in accordance with an embodiment of the present invention. In one embodiment, each opposing flat portion 2FF extends from an opposing side wall 5D of the housing 5 (FIG. 1).

When the dual mounting bracket 8 (FIG. 7) is detached from the opposing flat portions 2FF, the lighting apparatus 100 may be positioned to sit flat on a supporting surface 150. The support members 16 distributed evenly on the first supporting wall 5C of the housing 5 stabilize and support the lighting apparatus 100 when the lighting apparatus 100 is set flat on the supporting surface 150.

Figure 9:
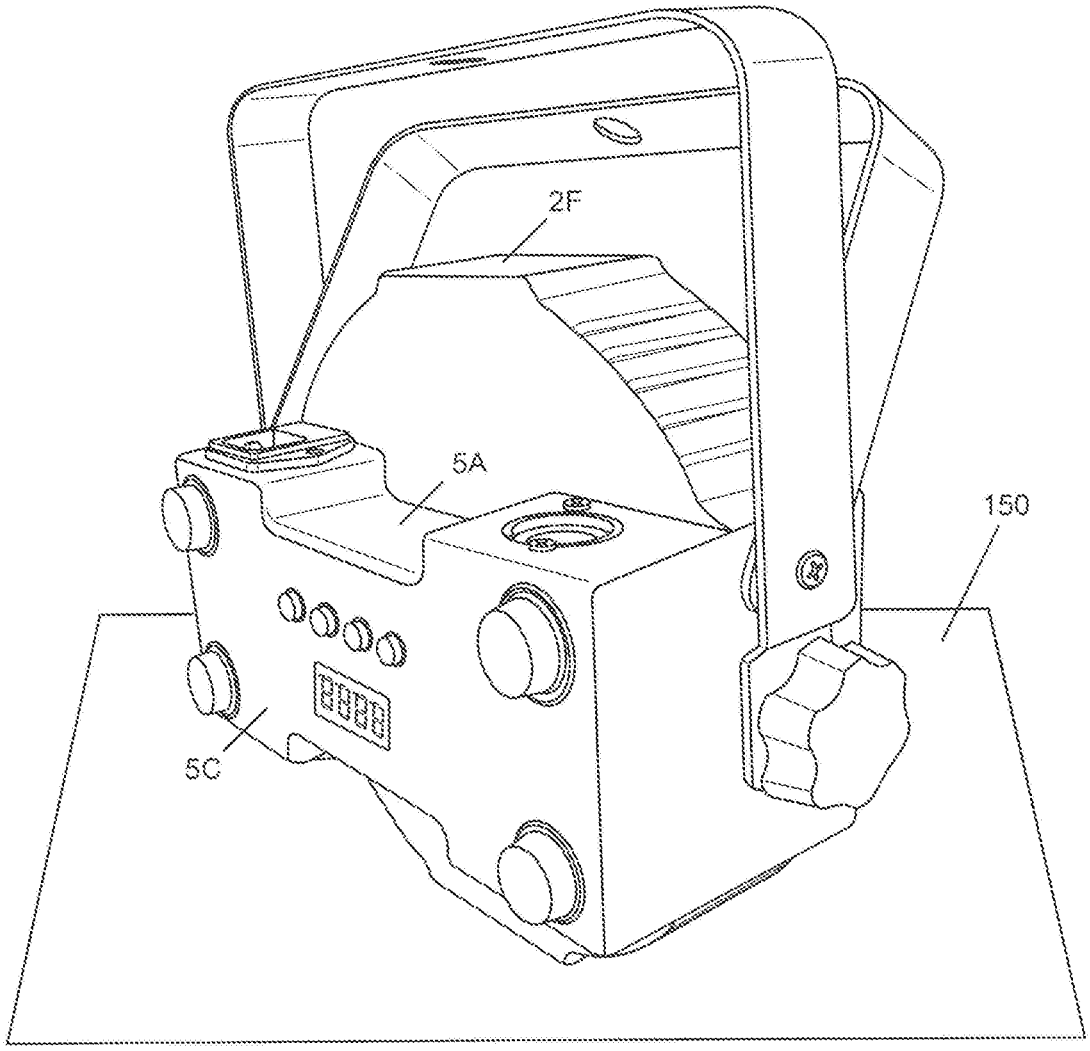
FIG. 9 illustrates a rear perspective view of the lighting apparatus, wherein the lighting apparatus is positioned to sit sideways, in accordance with an embodiment of the invention.

FIG. 9 illustrates a rear perspective view of the lighting apparatus 100, wherein the lighting apparatus 100 is positioned to sit sideways, in accordance with an embodiment of the invention. As stated above, the housing 5 further includes the first pair of opposing flat portions 2F. In one embodiment, the first pair of opposing flat portions 2F are supporting walls. The lighting apparatus 100 may be positioned to sit sideways by resting a flat portion 2F of the housing 5 on a supporting surface 150, as shown in FIG. 9.

FIG. 10 is a block diagram illustrating multiple lighting apparatuses 100 arranged in a parallel video capture circuit 200, in accordance with an embodiment of the invention. The circuit 200 is controlled by a controller 102, such as a DMX compliant controller. Each lighting apparatus 100 receives data control signals (e.g., DMX signals) from the controller 102 via the data input connector 13B (FIG. 2).

Each lighting apparatus 100 in the circuit 200 may also be wirelessly controlled by a wireless DMX controller 400 (FIG. 5). As described above and illustrated in FIG. 5, a wireless DMX module 104G of each lighting apparatus 100 can wirelessly receive data control signals (e.g., DMX signals) from with a wireless DMX controller 400.

FIG. 11 is a block diagram illustrating multiple lighting apparatuses 100 linked in a daisy-chain video capture circuit 300, in accordance with an embodiment of the invention. The circuit 300 is controlled by a controller 102, such as a DMX compliant controller. In the daisy-chain circuit 300, data control signals (e.g., DMX signals) are sent as serial data that travel from one lighting apparatus 100 to another lighting apparatus 100 via the data I/O sockets 13A, 13B (FIGS. 2-3) of each lighting apparatus 100. Specifically, the data input connector 13B receives master/slave data control signals and the data output connector 13A transmits master/slave data control signals to the next lighting apparatus 100 in the master/slave circuit 300. For example, as shown in FIG. 11, a first lighting apparatus 100 (FIXTURE 1) receives data control signals from the controller 102. The first lighting apparatus 100 then transmits data control signals to a second lighting apparatus 100 (FIXTURE 2).

Each lighting apparatus 100 in the circuit 300 may also be wirelessly controlled by a wireless DMX controller 400 (FIG. 5). As described above and illustrated in FIG. 5, a wireless DMX module 104G of each lighting apparatus 100 can wirelessly receive data control signals (e.g., DMX signals) from with a wireless DMX controller 400.

Figure 12:
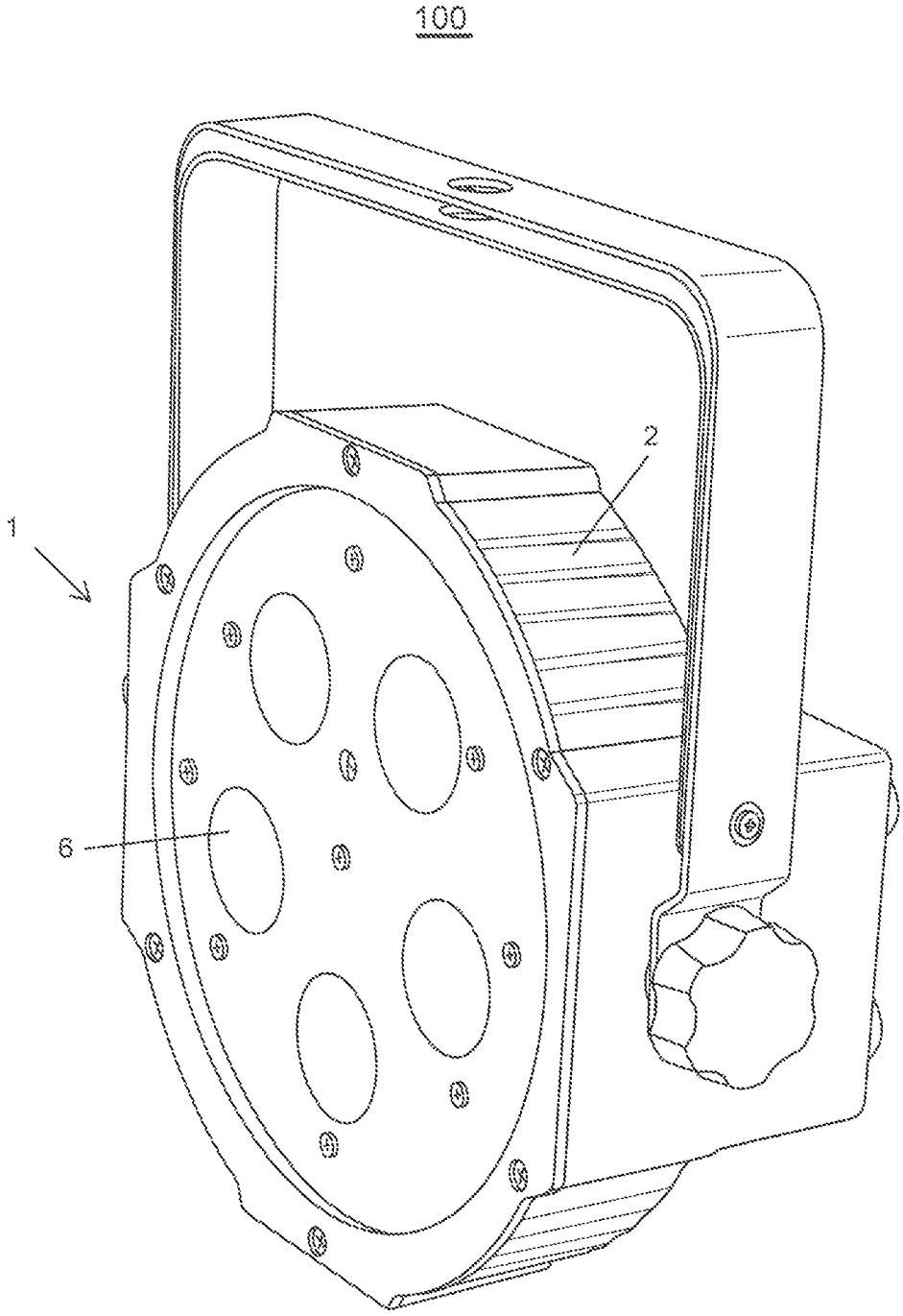
FIG. 12 illustrates an alternative arrangement of lighting elements on a lighting apparatus, in accordance with an embodiment of the present invention.

FIG. 12 illustrates an alternative arrangement of lighting elements 6 on a lighting apparatus 100, in accordance with an embodiment of the present invention. As stated above, the lighting frame 1 comprises the lighting panel 2. A plurality of lighting elements 6 are affixed to the lighting panel 2. The arrangement of the lighting elements 6 on the lighting panel 2 may vary. In one embodiment, the lighting elements 6 are spaced in a substantially circular arrangement.

Figure 13A:
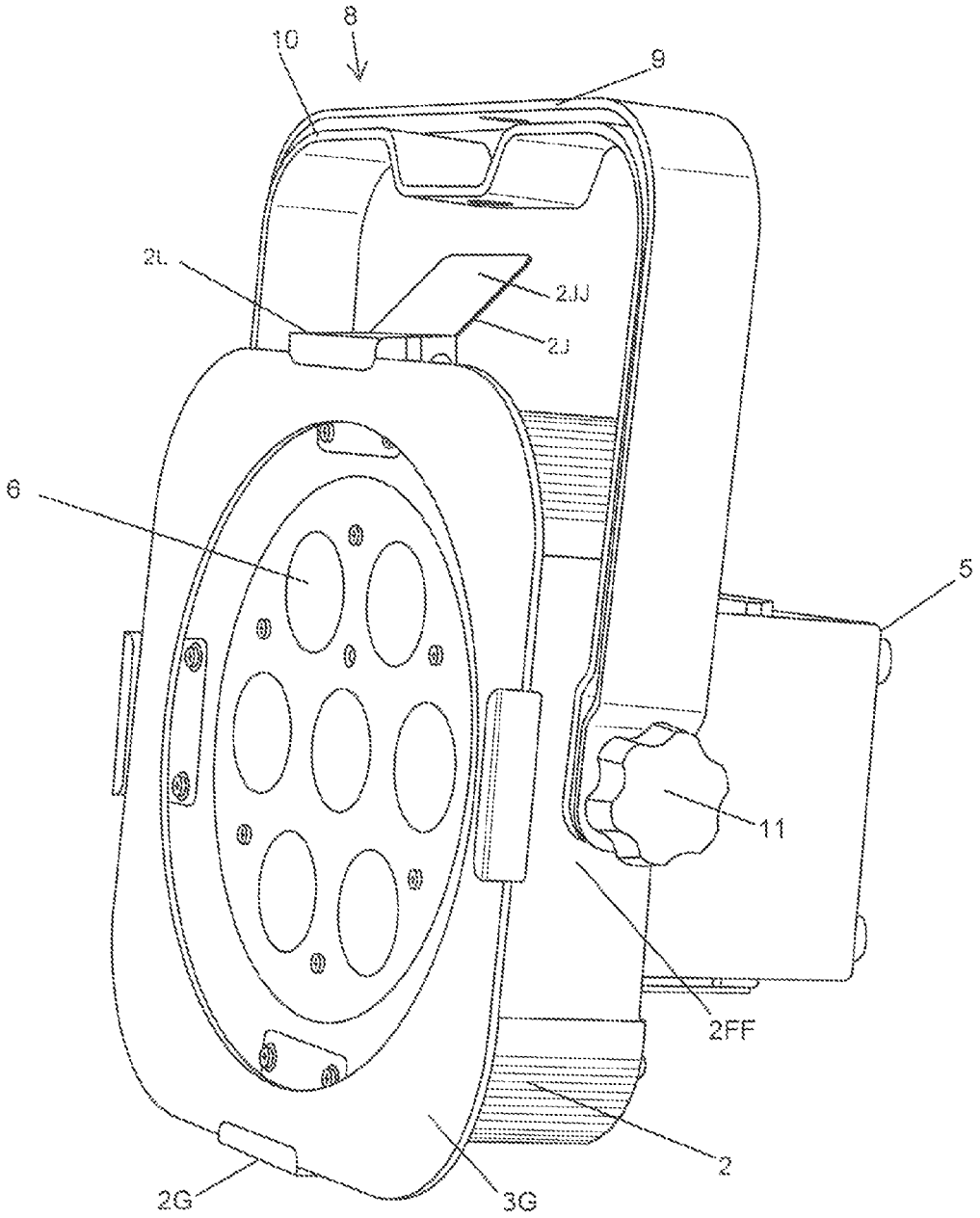
FIG. 13A illustrates a lighting apparatus with a gel frame, in accordance with an embodiment of the present invention.

FIG. 13A illustrates a lighting apparatus 100 with a gel frame 3G, in accordance with an embodiment of the present invention. As stated above, the shape of the lighting panel 2 may vary. In another embodiment, the lighting panel 2 is substantially square-shaped.

In another embodiment, the lighting apparatus 100 further comprises a removable gel frame 3G. The gel frame 3G may include a diffusion filter for modifying light from the lighting elements 6. The lighting panel 2 may include multiple retaining brackets 2G and a retaining clip 2J. The retaining brackets 2G and the retaining clip 2J are used to engage and secure the gel frame 3G to the lighting panel 2.

The retaining clip 2J includes a lip 2L and a projecting flange 2JJ extending from the lip 2L. The lip 2L is pivotable between a lowered position and a raised position. In FIG. 13A, the lip 2L is in the lowered position, thereby securing the gel frame 3G to the lighting panel 2. To remove the gel frame 3G from the lighting panel 2, a force is applied to the projecting flange 2JJ to raise up the lip 2L. The gel frame 3G is removed by pulling out/sliding out the gel frame 3G from engagement with the retaining brackets 2G when the lip 2L is raised. When the force applied to the projecting flange 2JJ is removed, the lip 2L returns to the lowered position.

In another embodiment, the brackets 9, 10 of the dual mounting bracket 8 are separately detachable. The first bracket 9 and the second bracket 10 are both detachably affixed via rotatable knobs 11 to the opposing flat portions 2FF of the housing 5. The first bracket 9 pivots independently of the second bracket 10, and the second bracket 10 pivots independently of the first bracket 9. An operator of the lighting apparatus 100 may mount, hang, or position the lighting apparatus 100 using only the first bracket 9, using only the second bracket 10, or using both the first bracket 9 and the second bracket 10.

Figure 13B:
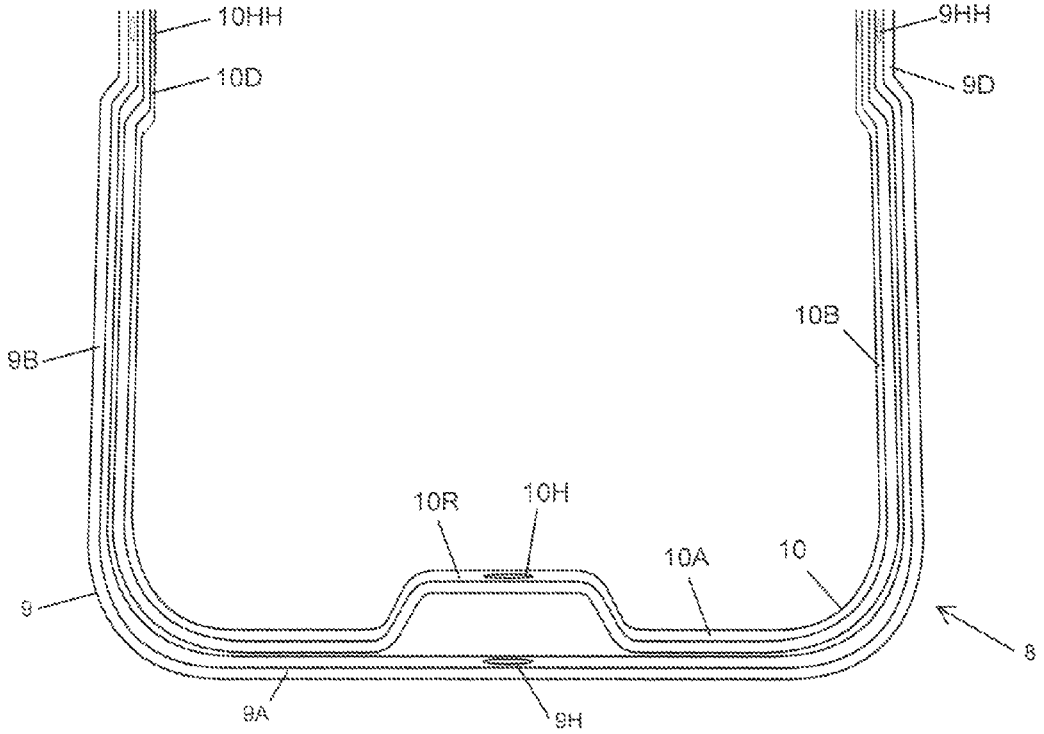
FIG. 13B illustrates a front perspective view of a detachable dual mounting bracket for a lighting apparatus, in accordance with an embodiment of the present invention.

FIG. 13B illustrates a front perspective view of a detachable dual mounting bracket 8 for a lighting apparatus 100, in accordance with an embodiment of the present invention. In another embodiment, the brackets 9, 10 of the dual mounting bracket 8 are separately detachable. The first bracket 9 comprises opposed first and second substantially rectangular planar legs 9B. The first bracket 9 further comprises a substantially rectangular planar elongate member 9A connecting the first and second legs 9B. Each leg 9B is disposed transverse (e.g., substantially perpendicular) to the elongate member 9A such that the legs 9B extend substantially parallel to each other. The legs 9B are integrally formed with the elongate member 9A.

The first bracket 9 further comprises opposed first and second flanges 9D. The first and second flanges 9D are integrally formed with the first and second legs 9B, respectively. Each flange 9D includes an aperture 9HH for receiving a screw 11A of a rotatable knob 11. The first and the second rotatable knob 11 secure the first and second flanges 9D to the opposing flat portions 2FF of the housing 5.

The second bracket 8 pivots independently of the first bracket 9. The second bracket 10 comprises opposed first and second substantially rectangular planar legs 10B. The second bracket 10 further comprises a substantially rectangular elongate member 10A connecting the first and second legs 10B. The center of the elongate member 10A may include a raised portion 10R. Each leg 10B is disposed transverse (e.g., substantially perpendicular) to the elongate member 10A such that the legs 10B extend substantially parallel to each other. The legs 10B are integrally formed with the elongate member 10A.

The second bracket 10 further comprises opposed first and second flanges 10D. The first and second flanges 10D are integrally formed with the first and second legs 10B, respectively. Each flange 10D includes an aperture 10HH for receiving a screw 11A of a rotatable knob 11. The first and the second rotatable knob 11 secure the first and second flanges 10D to the opposing flat portions 2FF of the housing 5.

The first bracket 9 is shaped to receive the second bracket 10 when the brackets 9 and 10 are aligned, as shown in FIG. 13B. Specifically, the length of the elongate member 10A is smaller than the length of the elongate member 9A, and the height of the legs 10B is smaller than the height of the legs 9B. These differences in physical dimension allow for the second bracket 10 to be fitted between the legs 9B of the first bracket 9 when the brackets 9 and 10 are aligned.

The elongate member 9A of the first bracket 9 comprises a center hole 9H disposed at a center of the elongate member 9A. The raised portion 10R of the second bracket 10 comprises a center hole 10H. The center holes 9H and 10H are positioned such that when the brackets 9 and 10 are aligned, the center holes 9H and 10H are also aligned. A fastener can then be inserted through the aligned center holes 9H and 10H to secure the lighting apparatus 100 to a floor stand, a wall, a lighting grid, a truss, a ground, or a surface. The fastener may be a screw, a bolt, a stud, or the like.

Figure 13C:
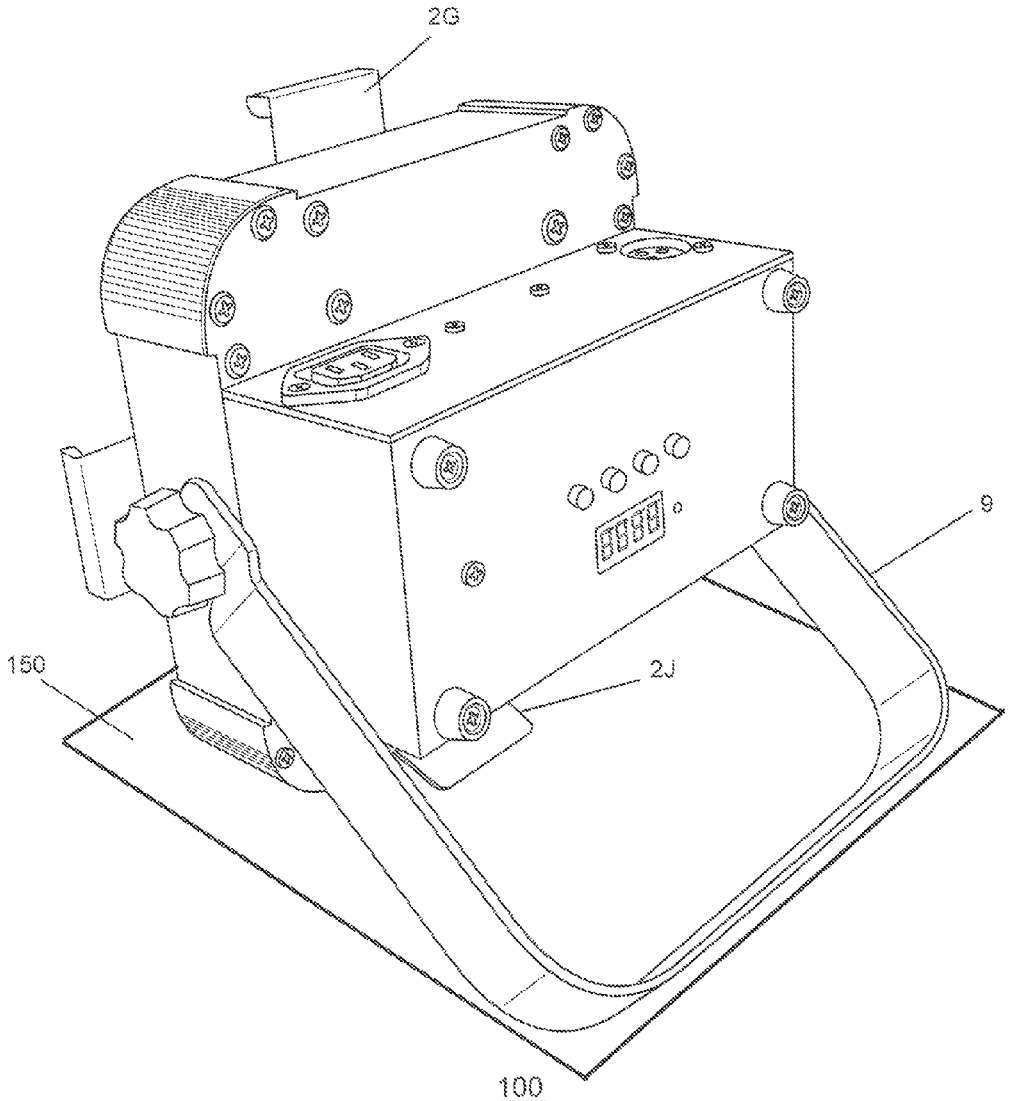
FIG. 13C illustrates a rear perspective view of a lighting apparatus, wherein the lighting apparatus is positioned to stand sideways, in accordance with an embodiment of the invention.

FIG. 13C illustrates a rear perspective view of a lighting apparatus 100, wherein the lighting apparatus 100 is positioned to stand sideways, in accordance with an embodiment of the invention. In FIG. 13C, the gel frame 3G (FIG. 13A) is removed. As stated above, the second bracket 10 (FIG. 13A) is detachable. An operator of the lighting apparatus 100 may mount, hang, or position the lighting apparatus 100 using only the first bracket 9. In FIG. 13C, the lighting apparatus 100 is positioned to stand sideways on a supporting surface 150 using only the first bracket 9. The lighting apparatus 100 is further supported by resting the retaining clip 2J against the supporting surface 150.

Figure 14A:
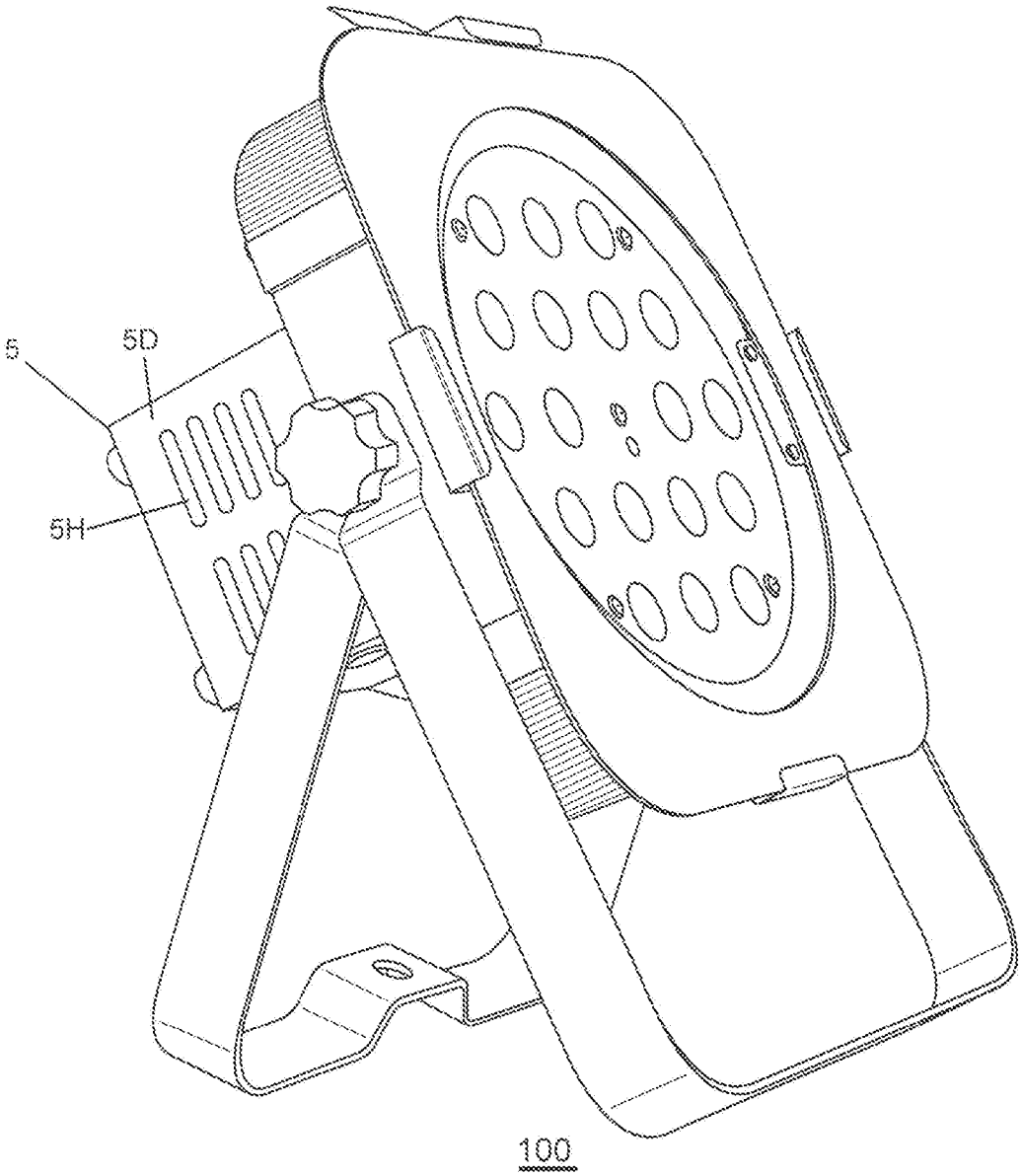
FIG. 14A illustrates a lighting apparatus with air-vent openings, in accordance with an embodiment of the present invention.

FIG. 14A illustrates a lighting apparatus 100 with air-vent openings 5H, in accordance with an embodiment of the present invention. In another embodiment of the invention, the lighting apparatus 100 is fan-cooled. The housing 5 may contain one or more fans 25 (FIG. 14B) that prevent overheating of the lighting apparatus 100. Opposing side walls 5D of the housing 5 may include multiple air-vent openings 5H for airflow.

Figure 14B:
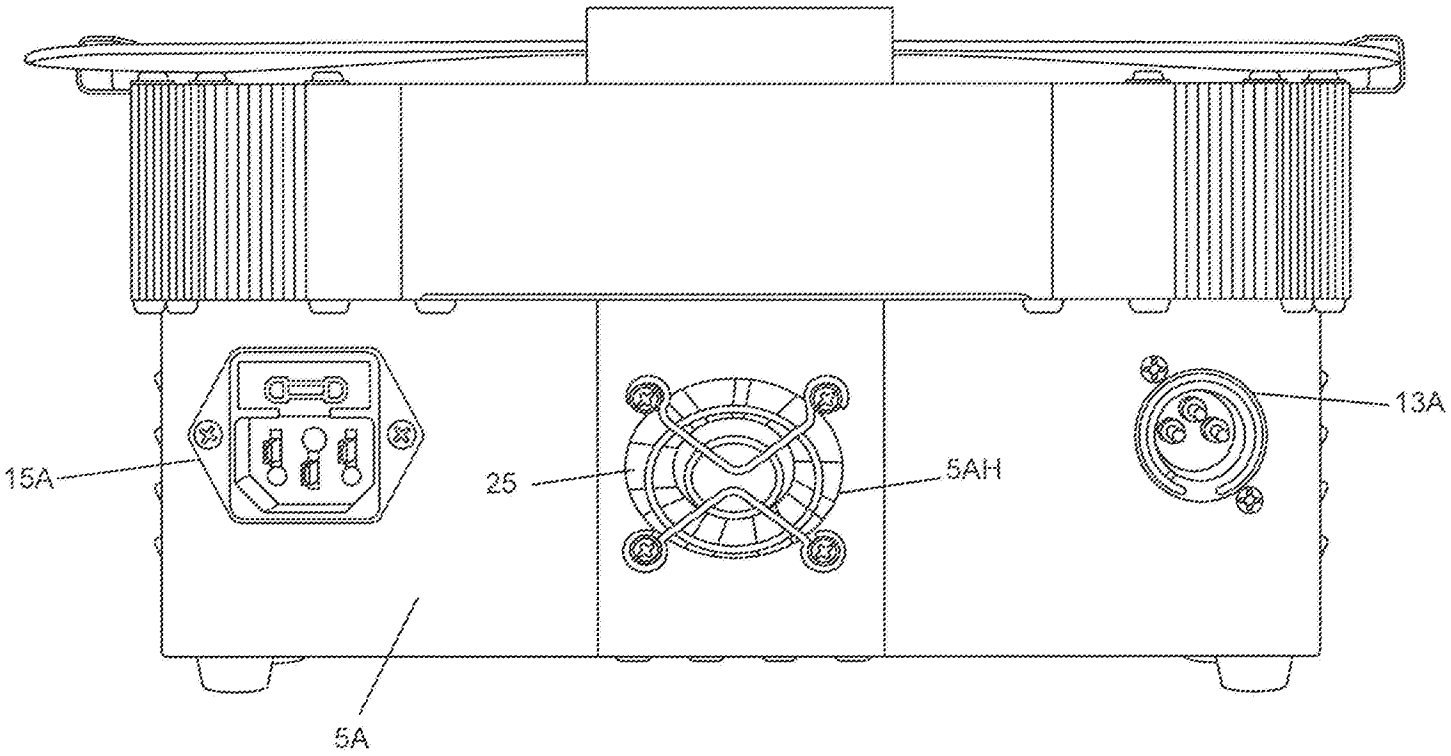
FIG. 14B illustrates a first side wall of a lighting apparatus, wherein the first side wall includes an air inlet, in accordance with an embodiment of the present invention.

FIG. 14B illustrates a first side wall 5A of a lighting apparatus 100, wherein the first side wall 5A includes an air inlet 5AH, in accordance with an embodiment of the present invention. As stated above, the first side wall 5A may comprise a power input socket 15A and a data input connector 13A. The first side wall 5A may further comprise an inlet 5AH for airflow. One or more fans 25 disposed inside the housing 5 (FIG. 1) draw in ambient air through the inlet 5AH to cool the lighting apparatus 100.

Figure 14C:
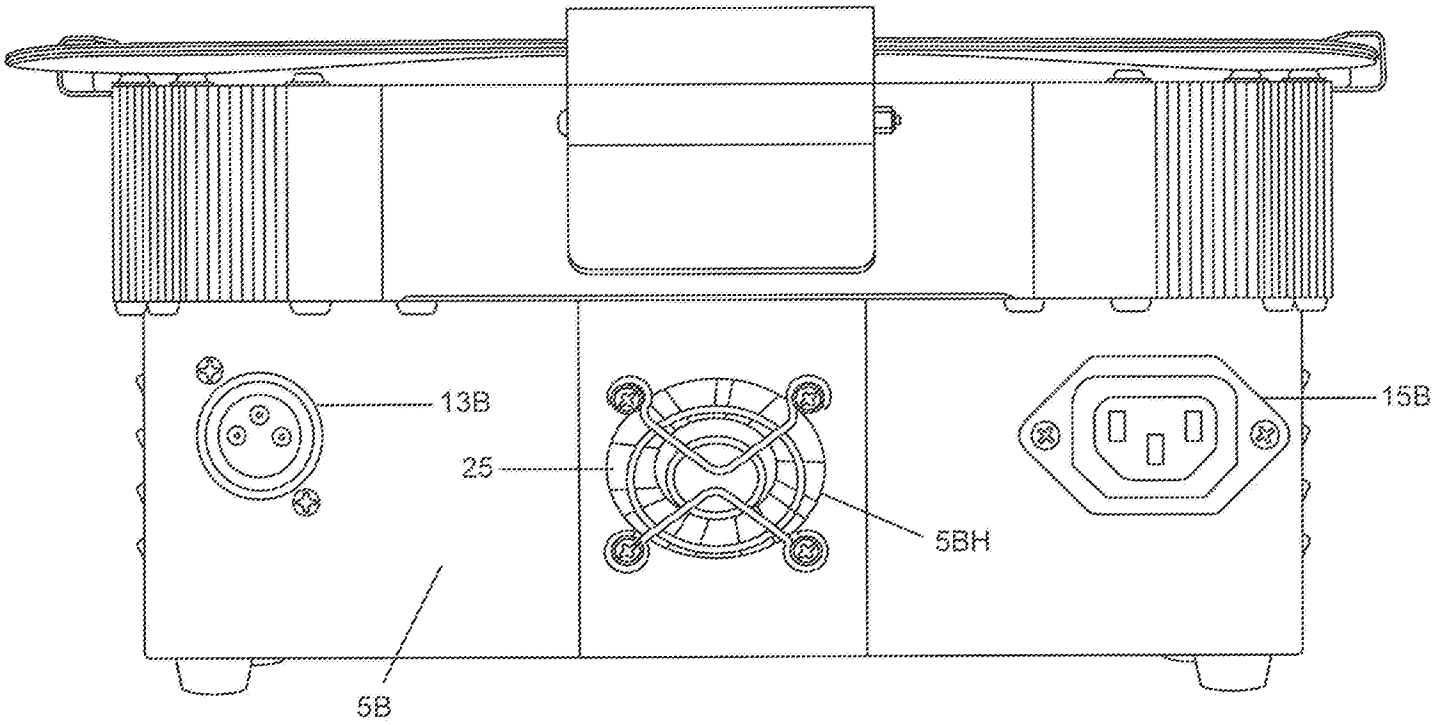
FIG. 14C illustrates a second side wall of a lighting apparatus, wherein the second side wall includes an air inlet, in accordance with an embodiment of the present invention.

FIG. 14C illustrates a second side wall 5B of a lighting apparatus 100, wherein the second side wall 5B includes an air inlet 5BH, in accordance with an embodiment of the present invention. As stated above, the second side wall 5B may comprise a power output socket 15B and a data output connector 13B. The second side wall 5B may further comprise an inlet 5BH for airflow. One or more fans 25 disposed inside the housing 5 (FIG. 1) draw in ambient air through the inlet 5BH to cool the lighting apparatus 100.

The present invention has been described in considerable detail with reference to certain preferred versions thereof; however, other versions are possible. The above description is made for the purpose of illustrating the general principles of the present invention and is not meant to limit the inventive concepts claimed herein. Further, particular features described above can be used in combination with other described features in each of the various possible combinations and permutations. Unless otherwise specifically defined herein, all terms should be given their broadest possible interpretation including meanings implied from the specification as well as meanings understood by those skilled in the art and/or as defined in dictionaries, treatises, etc. Therefore, the spirit and scope of the appended claims should not be limited to the description of the preferred versions contained herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A lighting apparatus, comprising:

a housing for maintaining a lighting frame, wherein the housing comprises:

at least one supporting wall;

a first side wall; and a second side wall that is substantially parallel to the first side wall, wherein the side walls are transverse to a supporting wall of the housing; and a position adjusting device comprising multiple support members attached to a supporting wall of the housing, wherein the support members facilitate positioning the supporting wall to rest against a supporting surface in a resting position, such that the supporting wall is substantially parallel to the supporting surface;

wherein each side wall comprises at least one input/output (I/O) connector for mating with a cable connector in a mating direction perpendicular to the side wall; and wherein each I/O connector of the lighting apparatus allows coupling the lighting apparatus to one or more other lighting apparatuses via one or more cables to form a modular lighting system of multiple lighting apparatuses that are spaced apart.

2. The lighting apparatus of claim 1, wherein:

the lighting frame includes a plurality of lighting elements.

3. The lighting apparatus of claim 2, wherein:

said at least one supporting wall includes a first supporting wall, wherein the first supporting wall extends transversely between the first side wall and the second side wall; and the first supporting wall includes:

multiple support members that stabilize and support the lighting apparatus when the lighting apparatus is positioned to sit flat on a surface;

an LCD display screen; and a plurality of manual control buttons;

wherein an operator can utilize the LCD display screen and the manual control buttons to control lighting effects of the lighting elements.

4. The lighting apparatus of claim 2, wherein:

the housing further comprises a control module for controlling the lighting elements, wherein the control module comprises a plurality of drivers; and said plurality of drivers include a lighting driver for controlling lighting effects of the lighting elements.

5. The lighting apparatus of claim 4, wherein:

at least one I/O connector of the lighting apparatus perpendicularly mates with a cable connector of an input cable transmitting data control signals from a controller; and the lighting driver controls the lighting effects of the lighting elements based in part on the data control signals from the controller.

6. The lighting apparatus of claim 5, wherein:

the controller is a Digital Multiplex (DMX) controller; and the data control signals from the controller include DMX data instructions.

7. The lighting apparatus of claim 4, further comprising:

a wireless DMX module for wirelessly receiving data control signals including DMX data instructions from a wireless DMX controller;

wherein the lighting driver controls the lighting effects of the lighting elements based in part on the data control signals from the wireless DMX controller.

8. The lighting apparatus of claim 1, wherein:

the first side wall includes at least one of the following I/O connectors: a power input socket for perpendicular mating with a cable connector of an input cable transmitting power, and a data input connector for perpendicular mating with a cable connector of an input cable transmitting input data control signals.

9. The lighting apparatus of claim 8, wherein:

the second side wall includes at least one of the following I/O connectors: a power output socket for perpendicular mating with a cable connector of an output cable transmitting power, and a data output connector for perpendicular mating with a cable connector of an output cable transmitting data control signals.

10. The lighting apparatus of claim 9, wherein each I/O connector of the lighting apparatus allows coupling the lighting apparatus to one or more other lighting apparatuses via one or more cables in a master/slave configuration where power or data control signals are provided serially from one lighting apparatus to another lighting apparatus via the one or more cables.

11. The lighting apparatus of claim 1, further comprising:

a detachable dual mounting bracket for mounting the lighting apparatus to one of the following supporting surfaces or structures: a floor stand, a wall, a lighting grid, a ceiling, and a truss.

12. The lighting apparatus of claim 1, wherein:

said at least one supporting wall further includes a pair of opposing flat portions, wherein the lighting apparatus may be positioned to sit sideways by resting a flat portion on a surface.

13. The lighting apparatus of claim 1, wherein the lighting apparatuses of the lighting system are spaced apart from one another by the one or more cables.

14. The lighting apparatus of claim 1, wherein each lighting apparatus of the lighting system is independently powerable or controllable.

15. The lighting apparatus of claim 1, wherein the position adjusting device adjusts a position of the housing, such that the housing is positionable in one of multiple positions.

16. The lighting apparatus of claim 15, wherein:

the position adjusting device further comprises at least one detachable bracket for coupling to the housing, wherein each bracket facilitates the tilting of the lighting frame about a substantially ninety degree angle to a desired orientation.

17. A lighting apparatus, comprising:

a housing for maintaining a lighting frame of the lighting apparatus, wherein the housing comprises:

at least one supporting wall;

a first side wall; and a second side wall that is substantially parallel to the first side wall, wherein the side walls are transverse to a supporting wall of the housing; and a position adjusting device comprising a retaining clip attached to the lighting frame, wherein the retaining clip facilitates positioning a side of the lighting frame to rest against a supporting surface in a standing position, such that the lighting frame and a supporting wall of the housing are substantially transverse to the supporting surface;

wherein each side wall comprises at least one input/output (I/O) connector for mating with a cable connector in a mating direction perpendicular to the side wall; and wherein each I/O connector of lighting apparatus allows coupling the lighting apparatus to one or more other lighting apparatuses via one or more cables to form a modular lighting system of multiple lighting apparatuses that are spaced apart.

18. The lighting apparatus of claim 17, wherein:

the lighting frame of the lighting apparatus includes a plurality of lighting elements;

the first side wall of the lighting apparatus includes at least one of the following I/O connectors: a power input socket for perpendicular mating with a cable connector of an input cable transmitting power, and a data input connector for perpendicular mating with a cable connector of an input cable transmitting input data control signals; and the second side wall of the lighting apparatus includes at least one of the following I/O connectors: a power output socket for perpendicular mating with a cable connector of an output cable transmitting power, and a data output connector for perpendicular mating with a cable connector of an output cable transmitting data control signals.

19. The lighting apparatus of claim 18, wherein:

said at least one supporting wall of the lighting apparatus includes a first supporting wall, wherein the first supporting wall extends transversely between the first side wall and the second side wall of the lighting apparatus; and the first supporting wall of the lighting apparatus comprises:

multiple support members that stabilize and support the lighting apparatus when the lighting apparatus is positioned to sit flat on a surface;

an LCD display screen; and a plurality of manual control buttons;

wherein an operator can utilize the LCD display screen and the manual control buttons to control the lighting effects of lighting elements of the lighting apparatus.

20. The lighting apparatus of claim 17, further comprising:

a detachable dual mounting bracket for mounting the lighting apparatus to one of the following supporting surfaces or structures: a floor stand, a wall, a lighting grid, a ceiling, and a truss.

21. The lighting apparatus of claim 17, wherein:

said at least one supporting wall of the lighting apparatus further includes a pair of opposing flat portions, wherein the lighting apparatus may be positioned to sit sideways by resting a flat portion on a surface.

22. The lighting apparatus of claim 17, wherein each I/O connector of the lighting apparatus allows coupling the lighting apparatus to one or more other lighting apparatuses via one or more cables in a master/slave configuration where power or data control signals are provided serially from one lighting apparatus to another lighting apparatus via the one or more cables.

23. A lighting apparatus, comprising:

a housing for maintaining a lighting frame of the lighting apparatus, wherein the housing comprises:

at least one supporting wall;

a first side wall; and a second side wall that is substantially parallel to the first side wall, wherein the side walls are transverse to a supporting wall of the housing; and a position adjusting device comprising at least one flat portion included in the housing, wherein each flat portion facilitates positioning a side of the lighting frame to rest against a supporting surface in a standing position, such that the lighting frame and a supporting wall of the housing are substantially transverse to the supporting surface;

wherein each side wall comprises at least one input/output (I/O) connector for mating with a cable connector in a mating direction perpendicular to the side wall; and wherein each I/O connector of the lighting apparatus allows coupling the lighting apparatus to one or more other lighting apparatuses via one or more cables to form a modular lighting system of multiple lighting apparatuses that are spaced apart.

24. The lighting apparatus of claim 23, wherein:

the first side wall includes at least one of the following I/O connectors: a power input socket for perpendicular mating with a cable connector of an input cable transmitting power, and a data input connector for perpendicular mating with a cable connector of an input cable transmitting input data control signals; and the second side wall includes at least one of the following I/O connectors: a power output socket for perpendicular mating with a cable connector of an output cable transmitting power, and a data output connector for perpendicular mating with a cable connector of an output cable transmitting data control signals.

25. The lighting apparatus of claim 23, wherein:

the lighting frame includes a plurality of lighting elements;

said at least one supporting wall includes a first supporting wall, wherein the first supporting wall extends transversely between the first side wall and the second side wall; and the first supporting wall includes:

multiple support members that stabilize and support the lighting apparatus when the lighting apparatus is positioned to sit flat on a surface;

an LCD display screen; and a plurality of manual control buttons;

wherein an operator can utilize the LCD display screen and the manual control buttons to control lighting effects of the lighting elements.

26. The lighting apparatus of claim 23, wherein:

said at least one supporting wall further includes a pair of opposing flat portions, wherein the lighting apparatus may be positioned to sit sideways by resting a flat portion on a surface.

27. The lighting apparatus of claim 23, wherein each I/O connector of the lighting apparatus allows coupling the lighting apparatus to one or more other lighting apparatuses via one or more cables in a master/slave configuration where power or data control signals are provided serially from one lighting apparatus to another lighting apparatus via the one or more cables.

* * * * *